US012654924B2

(12) United States Patent
Graham et al.

(10) Patent No.: US 12,654,924 B2
(45) Date of Patent: Jun. 16, 2026

(54) POD CAPSULES

(71) Applicant: ECO.LOGIC BRANDS INC., Manteca, CA (US)

(72) Inventors: Romeo Graham, Manteca, CA (US); Julie Corbett, Manteca, CA (US)

(73) Assignee: ECO.LOGIC BRANDS INC., Manteca, CA (US)

( * ) Notice: Subject to any disclaimer, the term of this patent is extended or adjusted under 35 U.S.C. 154(b) by 256 days.

(21) Appl. No.: 18/568,345

(22) PCT Filed: Jun. 29, 2022

(86) PCT No.: PCT/US2022/035510
§ 371 (c)(1),
(2) Date: Dec. 8, 2023

(87) PCT Pub. No.: WO2023/283087
PCT Pub. Date: Jan. 12, 2023

(65) Prior Publication Data

US 2024/0270470 A1 Aug. 15, 2024

Related U.S. Application Data

(60) Provisional application No. 63/218,667, filed on Jul. 6, 2021.

(51) Int. Cl.

| | |
|---|---|
| ***B65D 77/20*** | (2006.01) |
| ***B65D 1/36*** | (2006.01) |
| ***B65D 65/46*** | (2006.01) |

(52) U.S. Cl.
CPC ..... *B65D 77/2056* (2013.01); *B65D 1/36* (2013.01); *B65D 65/466* (2013.01); *B65D 2565/385* (2013.01); *B65D 2577/205* (2013.01)

(58) Field of Classification Search
CPC .... B65D 77/2056; B65D 1/36; B65D 65/466; B65D 2565/385; B65D 2577/205
(Continued)

(56) References Cited

U.S. PATENT DOCUMENTS 3,321,123 A * 5/1967 Stafford ..... B29C 66/712 156/308.2
3,443,741 A * 5/1969 Stockdale ..... B65D 77/2024 229/123.1
(Continued)

FOREIGN PATENT DOCUMENTS

CH 634520 A5 2/1983
EP 0359847 B1 12/1993
(Continued)

*Primary Examiner* — David J Walczak
(74) *Attorney, Agent, or Firm* — Young Basile Hanlon & MacFarlane, P.C.

(57) ABSTRACT

Pod capsules and methods for making same. A pod capsule includes a sustainable material pod capsule container. The sustainable material pod capsule container including a flange, a sidewall connected to the flange, an external surface of the sidewall including gripping sections, and a base connected to the sidewall. The pod capsule includes a lid configured to be fused to the sustainable material pod capsule container, the lid including at least a removeable portion. Squeezing of the gripping sections causes contents in the pod capsule to be dispensed via a released removeable portion through a deformable contoured dispensing area.

21 Claims, 25 Drawing Sheets

(58) Field of Classification Search
USPC ..... 222/81; 220/669, 670, 675, 6, 907; 206/218, 223
See application file for complete search history.

(56) References Cited

U.S. PATENT DOCUMENTS

| | | | | |
|---|---|---|---|---|
| 4,209,126 | A | 6/1980 | Elias | |
| 5,009,364 | A * | 4/1991 | Bolte | B65D 77/206 D34/1 |
| D645,754 | S | 9/2011 | Corbett et al. | |
| 8,430,262 | B2 | 4/2013 | Corbett et al. | |
| D692,768 | S | 11/2013 | Corbett et al. | |
| D692,769 | S | 11/2013 | Corbett et al. | |
| D694,635 | S | 12/2013 | Corbett et al. | |
| 8,663,419 | B2 | 3/2014 | Corbett et al. | |
| 8,807,377 | B2 | 8/2014 | Corbett et al. | |
| 8,991,635 | B2 | 3/2015 | Myerscough | |
| 9,126,717 | B2 | 9/2015 | Myerscough | |
| 9,126,719 | B2 | 9/2015 | Corbett et al. | |
| 9,452,857 | B2 | 9/2016 | Corbett et al. | |
| 9,574,307 | B2 | 2/2017 | Corbett et al. | |
| 10,005,222 | B2 | 6/2018 | Corbett et al. | |
| 10,005,605 | B2 | 6/2018 | Corbett et al. | |
| 11,167,904 | B2 | 11/2021 | Corbett et al. | |
| 11,286,104 | B2 | 3/2022 | Corbett et al. | |
| 11,383,887 | B2 | 7/2022 | Corbett et al. | |
| 2011/0290798 | A1 | 12/2011 | Corbett et al. | |
| 2012/0024897 | A1 | 2/2012 | Corbett et al. | |
| 2012/0145710 | A1 | 6/2012 | Corbett et al. | |
| 2014/0151396 | A1 | 6/2014 | Stehli, Jr. et al. | |
| 2014/0252032 | A1 | 9/2014 | Corbett et al. | |
| 2015/0314916 | A1 | 11/2015 | Corbett et al. | |
| 2016/0159528 | A1 | 6/2016 | Kessell et al. | |
| 2016/0159545 | A1 | 6/2016 | Corbett et al. | |
| 2019/0135479 | A1 | 5/2019 | Corbett et al. | |
| 2021/0284418 | A1 | 9/2021 | Corbett et al. | |
| 2022/0169437 | A1 | 6/2022 | Corbett et al. | |
| 2022/0340335 | A1 | 10/2022 | Corbett et al. | |
| 2023/0054953 | A1 | 2/2023 | Graham et al. | |
| 2023/0331449 | A1 | 10/2023 | Graham et al. | |
| 2023/0371675 | A1 | 11/2023 | Graham et al. | |

FOREIGN PATENT DOCUMENTS

| | | | |
|---|---|---|---|
| EP | 2100823 | A1 | 9/2009 |
| EP | 1334045 | B1 | 7/2012 |
| EP | 2599735 | B1 | 4/2016 |
| EP | 2566785 | B1 | 9/2016 |
| EP | 3263485 | B1 | 1/2021 |
| KR | 100902264 | B1 | 6/2009 |
| KR | 20170120340 | A | 10/2017 |
| KR | 101813556 | B1 | 12/2017 |
| WO | 2013128443 | A1 | 9/2013 |
| WO | 2014031869 | A1 | 2/2014 |
| WO | 2021079267 | A1 | 4/2021 |
| WO | 2022055921 | A1 | 3/2022 |

* cited by examiner

POD CAPSULES

CROSS-REFERENCE TO RELATED APPLICATION(S)

This application is a national stage entry of International Patent Application Serial No. PCT/US2022/035510, filed Jun. 29, 2022, which claims priority to U.S. Provisional Application Ser. No. 63/218,667, filed Jul. 6, 2021, the entire disclosures of which are incorporated herein.

TECHNICAL FIELD

This disclosure relates to packaging and in particular, to pod capsules which contain contents.

BACKGROUND

Many single use pod capsules such as creamers, jams, dipping sauces, and coffee capsules are designed so that the consumer peels off the top film and pours the contents into a wider mouth container such a coffee mug or directly onto a plate with edibles. In such cases, there is no harm if the contents spill on the table, clothes, or touch the consumer's skin as the contents are not corrosive. In some cases, the pod capsules are filled with concentrated chemistry, which when exposed to human skin can result in rashes, blisters, and similar skin issue. Nausea or worse can happen if the concentrated chemistry is ingested by the consumer. These type of pod capsules are can be sealed with a dissolvable membrane, which when in contact with water can slowly dissolve.

In the effort to eliminate and or reduce plastic and substitute to more environmental packaging, one must start reducing the amount of liquid in products and reformulate them into concentrate such as powders, granules, or concentrated liquid formulas. These concentrates can be sold in pod capsules, capsules, or small glass or plastic vials or bottles. In all these instances, containers are overpackaged to ensure customer safety for the reasons mentioned above and therefore, fall short of plastic reduction or elimination goals.

SUMMARY

Disclosed herein are methods and systems for pod capsule packages and packaging.

In some implementations, pod capsule includes a sustainable material pod capsule container. The sustainable material pod capsule container including a flange, a sidewall connected to the flange, an external surface of the sidewall including gripping sections, and a base connected to the sidewall. The pod capsule includes a lid configured to be fused to the sustainable material pod capsule container, the lid including at least a removeable portion. Squeezing of the gripping sections causes contents in the pod capsule to be dispensed via a released removeable portion through a deformable contoured dispensing area

BRIEF DESCRIPTION OF THE DRAWINGS

The disclosure is best understood from the following detailed description when read in conjunction with the accompanying drawings and are incorporated into and thus constitute a part of this specification. It is emphasized that, according to common practice, the various features of the drawings are not to-scale. On the contrary, the dimensions of the various features are arbitrarily expanded or reduced for clarity.

DETAILED DESCRIPTION

Figure 1:
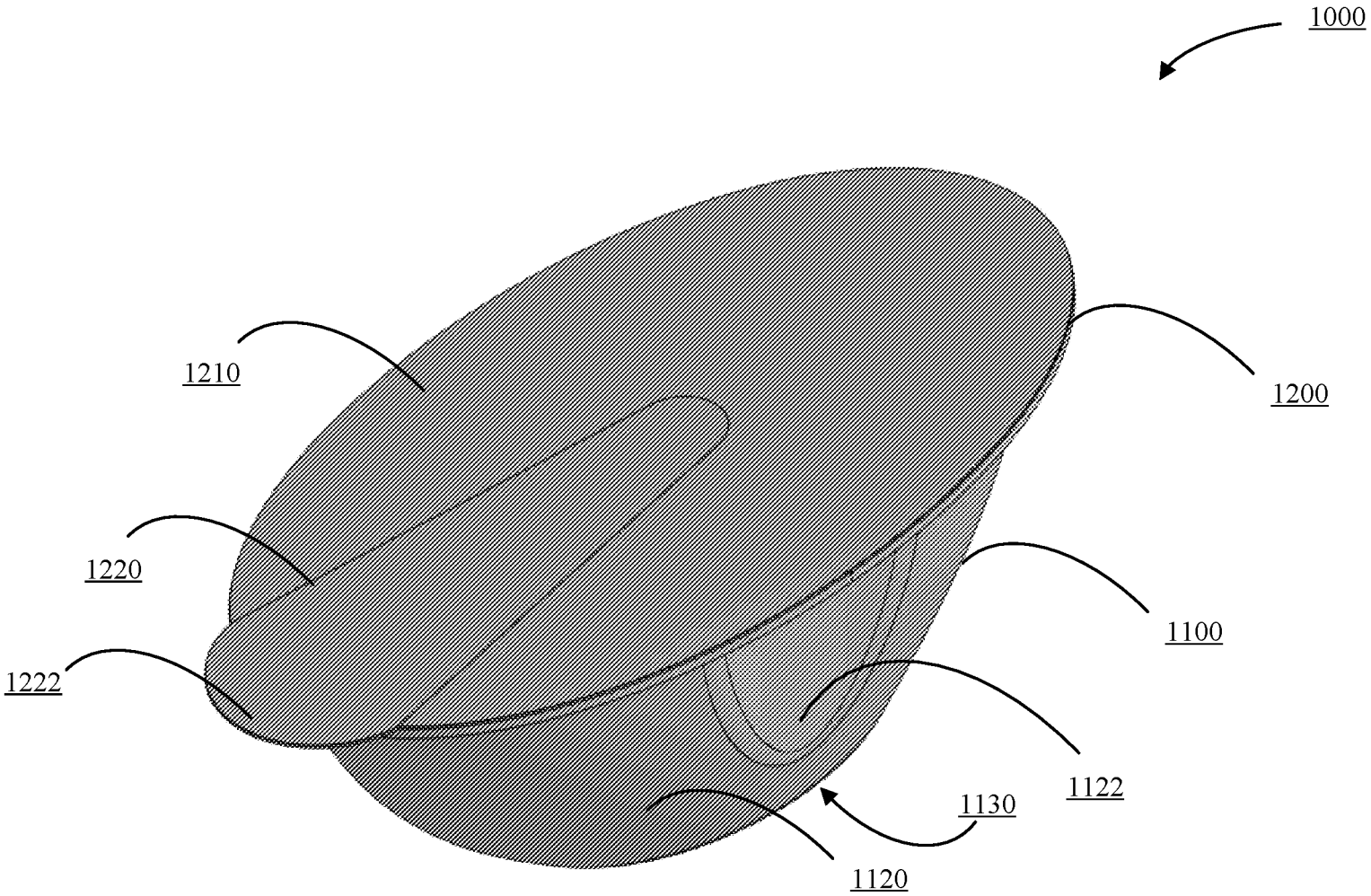
FIG. 1 is a diagram of a pod capsule in a sealed state in accordance with implementations.

The figures and descriptions provided herein may be simplified to illustrate aspects of the described embodiments that are relevant for a clear understanding of the herein disclosed processes, machines, manufactures, and/or compositions of matter, while eliminating for the purpose of clarity other aspects that may be found in typical similar devices, systems, compositions and methods. Those of ordinary skill may thus recognize that other elements and/or steps may be desirable or necessary to implement the devices, systems, compositions and methods described herein. However, because such elements and steps are well known in the art, and because they do not facilitate a better understanding of the disclosed embodiments, a discussion of such elements and steps may not be provided herein. However, the present disclosure is deemed to inherently include all such elements, variations, and modifications to the described aspects that would be known to those of ordinary skill in the pertinent art in light of the discussion herein.

Embodiments are provided throughout so that this disclosure is sufficiently thorough and fully conveys the scope of the disclosed embodiments to those who are skilled in the art. Numerous specific details are set forth, such as examples of specific aspects, devices, and methods, to provide a thorough understanding of embodiments of the present disclosure. Nevertheless, it will be apparent to those skilled in the art that certain specific disclosed details need not be employed, and that embodiments may be embodied in different forms. As such, the exemplary embodiments set forth should not be construed to limit the scope of the disclosure.

The terminology used herein is for the purpose of describing particular embodiments only and is not intended to be limiting. For example, as used herein, the singular forms "a", "an" and "the" may be intended to include the plural forms as well, unless the context clearly indicates otherwise. The terms "comprises," "comprising," "including," and "having," are inclusive and therefore specify the presence of stated features, steps, operations, elements, and/or components, but do not preclude the presence or addition of one or more other features, steps, operations, elements, components, and/or groups thereof.

The steps, processes, and operations described herein are thus not to be construed as necessarily requiring their respective performance in the particular order discussed or illustrated, unless specifically identified as a preferred or required order of performance. It is also to be understood that additional or alternative steps may be employed, in place of or in conjunction with the disclosed aspects.

Yet further, although the terms first, second, third, etc. may be used herein to describe various elements, steps or aspects, these elements, steps or aspects should not be limited by these terms. These terms may be only used to distinguish one element or aspect from another. Thus, terms such as "first," "second," and other numerical terms when used herein do not imply a sequence or order unless clearly indicated by the context. Thus, a first element, step, component, region, layer or section discussed below could be termed a second element, step, component, region, layer or section without departing from the teachings of the disclosure.

The non-limiting embodiments described herein are with respect to pod capsules and methods for making the pod capsules. The pod capsules and methods for making the pod capsules may be modified for a variety of applications and uses while remaining within the spirit and scope of the claims. The embodiments and variations described herein, and/or shown in the drawings, are presented by way of example only and are not limiting as to the scope and spirit. The descriptions herein may be applicable to all embodiments of the fusion packages and the methods for making the fusion packages.

Disclosed herein are implementations of pod capsules and methods for making the pod capsules. The implementations shown are illustrative and other implementations are within the scope of the specification and claims described herein. For purposes of illustration, certain aspects, features, and the like are described with respect to implementations. These aspects, features, and the like are appropriately applicable to and interchangeable with other implementations described herein.

In implementations, the pod capsules described herein can be manufactured using combinations of injection molding (IM), in-mold labeling (IML), die cutting, compression blow molding, thermoform molding, and the like processing (collectively "structure forming process") to form a pod capsule container and the like (collectively "pod capsule container") with IM, IML, heat, induction, mechanical, staking, ultrasonic, and adhesive or chemical bonding (collectively "join processing") to fuse, weld, or bond (collectively "fuse") the pod capsule container with a peelable and/or deformable lid (collectively "lid") to create a sealed package or pod capsule (collectively "pod capsule") which can hold content or materials. In implementations, the fusing can include application of pressure, temperature, and/or combinations thereof. In implementations, the pod capsule is an integrally, hermetically pod capsule. In implementations, the pod capsule can be configured to contain liquid, concentrated liquid, powder, granules, dry content, or non-dry content or materials, for example.

In implementations, the pod capsule container can be made using the structure forming processes from polymers, sustainable materials, recyclable materials, biodegradable materials, bio-based resins, weight-optimized biodegradable plastic, molded fiber, molded paper, molded pulp, fiber, paper, pulp, paperboard, pressed pulp, fiber based, pressed fiber, paper, starch, cellulose, recycled plastic film, metals, metalized film, biodegradable resins such as Polylactic acid (PLA), Polyhydroxyalkanoates (PHA), Polyhydroxybutyrate (PHB), Polyethylene Furanoate (PEF), and combinations thereof.

In implementations, the pod capsule container can be made using the structure forming processes from sustainable materials which can include at least one of recyclable materials, biodegradable materials, bio-based resins, weight-optimized biodegradable plastic, molded fiber, molded paper, molded pulp, fiber, paper, pulp paperboard, pressed pulp, fiber based, pressed fiber, paper, starch, cellulose, recycled plastic film, biodegradable resins, polylactic acid, polyhydroxyalkanoates, polyhydroxybutyrate, or polyethylene furanoate.

In implementations, the lid can be made using the structure forming processes from polymers, sustainable materials, recyclable materials, biodegradable materials, bio-based resins, weight-optimized biodegradable plastic, paperboard, pressed pulp, heavy film, film, fiber based, pressed fiber, paper, starch, cellulose, recycled plastic film, metals, metalized film, biodegradable resins such as PLA, PHA, PHB, PEF, and combinations thereof.

In implementations, pod capsule container and lid can include a barrier layer or film on an internal or inside surface, where the barrier layer is impervious or substantially impervious to the content or material in the pod capsule and/or chemically inert or substantially chemically inert with respect to the content or material in the pod capsule. In implementations, the pod capsule container and/or lid can include an integrated or integrally formed barrier layer or film. In some implementations, the barrier layer can include one or more of an oxygen barrier, a moisture barrier, a grease barrier, a gas barrier, an oil barrier, and other barrier relevant to the content or material in the pod capsule. In some implementations, the oxygen barrier, the moisture barrier, the grease barrier, the gas barrier, the oil barrier, and the other barrier can be integral to or integrated with the barrier layer. In some implementations, the oxygen barrier, the moisture barrier, the grease barrier, the gas barrier, the oil barrier, and the other barrier can be separate layers formed on the barrier layer.

In implementations, the pod capsules can efficiently use recyclable, biodegradable, and the like materials for improved sustainability.

The pod capsules and methods described herein are environmentally friendly, compostable, and recyclable. The pod capsules can be filled with powders, granules, or concentrated liquids which are sealed with a lidding, membrane, or film (collectively referred to herein as "lid") and designed with pinch features on each side of the pod capsule and an aperture that is formed so that when held to precisely pour, and if needed, squeezed with the fingers to make the opening narrower so that the contents can be poured or dispensed, in a very guided way, into a small opening without direct human contact and or spillage and where the entire content can be fully evacuated into a bottle, jar, can, tub, or pail with little or no residue remaining inside the pod capsule. The removed contents are then reconstituted with water or other solvents to create products that are normally sold individually in plastic bottles.

In implementations, the pod capsule and components thereof can be molded into an oval or round shape using the described and/or disclosed materials and can be laminated or coated on an internal or inside surface with a barrier material and sealed with a lid which can be pre-perforated and or contain a tear away strip to provide a dispensing opening once a user is ready to use the product.

In implementations, the sides of the pod capsule can include functional indentations to facilitate dispensing. When the pod capsule is pinched or squeezed at the functional indentations, the pod capsule can deform, fold, and/or bend (collectively "deform") to open or release the lid or a portion thereof to create guiding features at the dispensing aperture mouth so that the product can flow evenly, and in its entirety, into a smaller opening of a bottle, jar, and/or cannister without spilling the contents or touching the contents with the fingers or other user body portion. That is, the pouring from the pod capsule is a directional or focused pour into a receiving structure. The contents of the pod capsules once in the bottle, jar, cannister, and the like are then easily dissolved in a certain volume of water and/or liquid and reconstituted into shampoos, personal care, and cleaning products as well as beverages or medicines to be used with a pump, cap, spray, and other dispensing closure known in the art.

In implementations, the pod capsule can include a pre-molded parting line in a bottom and/or side walls of the pod capsule container to facilitate the folding or bending of the pod capsule to create a more focused lip or passage for pouring or dispensing the contents.

In implementations, an aperture of the pod capsule can have different opening shapes such as a beak like-end, a rounded pouring lip, and other aperture-guiding shapes.

In implementations, the lid can include a defined area for perforations and/or a tear strip.

In implementations, the lid can include perforation features that match the width of a bottle, can, jar, or tub (collectively "receiving structure") to prevent the product from spilling outside a defined aperture of the receiving structure.

In implementations, deformation of the pod capsule by pinching or gripping on guide structures can cause the lid to pop open to facilitate pouring and once used, and decompressed, the lid will drop back into its resting position flat on the top surface of the pod capsule.

In implementations, adhesives used to attach the lid to a pod capsule flange can have different strength characteristics in different areas to preferentially open a certain location when the pod capsule is deformed by squeezing on side guide structures.

In implementations, the pod capsule can include two or more distinct and separate chambers. Once pinched or folded, the granules, powder, and or liquid in each chamber combines through a dispensing area, such as a guiding beak-type dispensing area, to pour all of the contents through the narrow neck of a bottle, tub, jar, and the like to be reconstitutes in a predetermined ratio.

In implementations, the pod capsules can be stackable and nestable during shipping to a content dispensing location.

Figure 2:
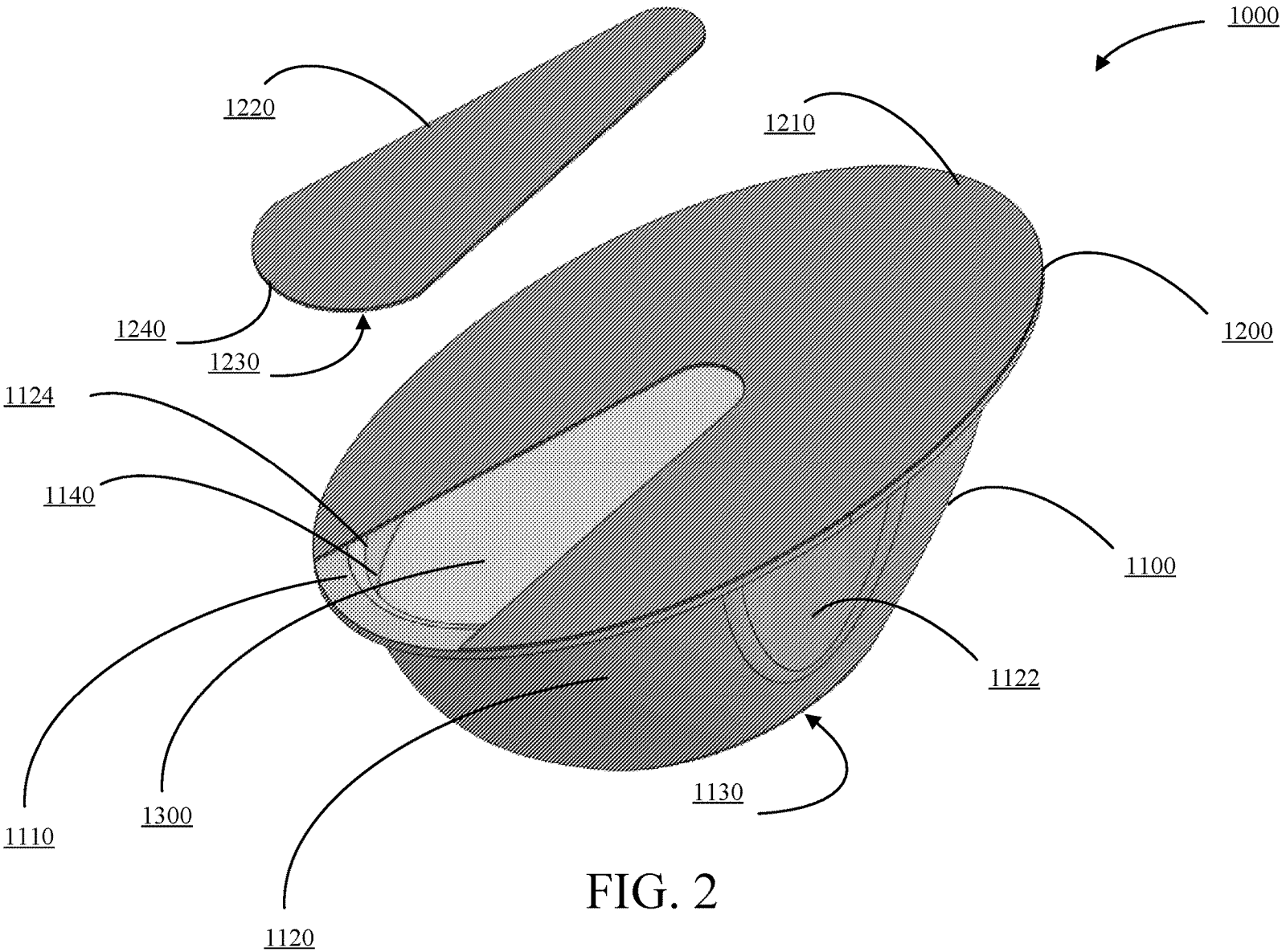
FIG. 2 is a diagram of the pod capsule of FIG. 1 in an unsealed state in accordance with implementations.
Figures 3A, 3B:
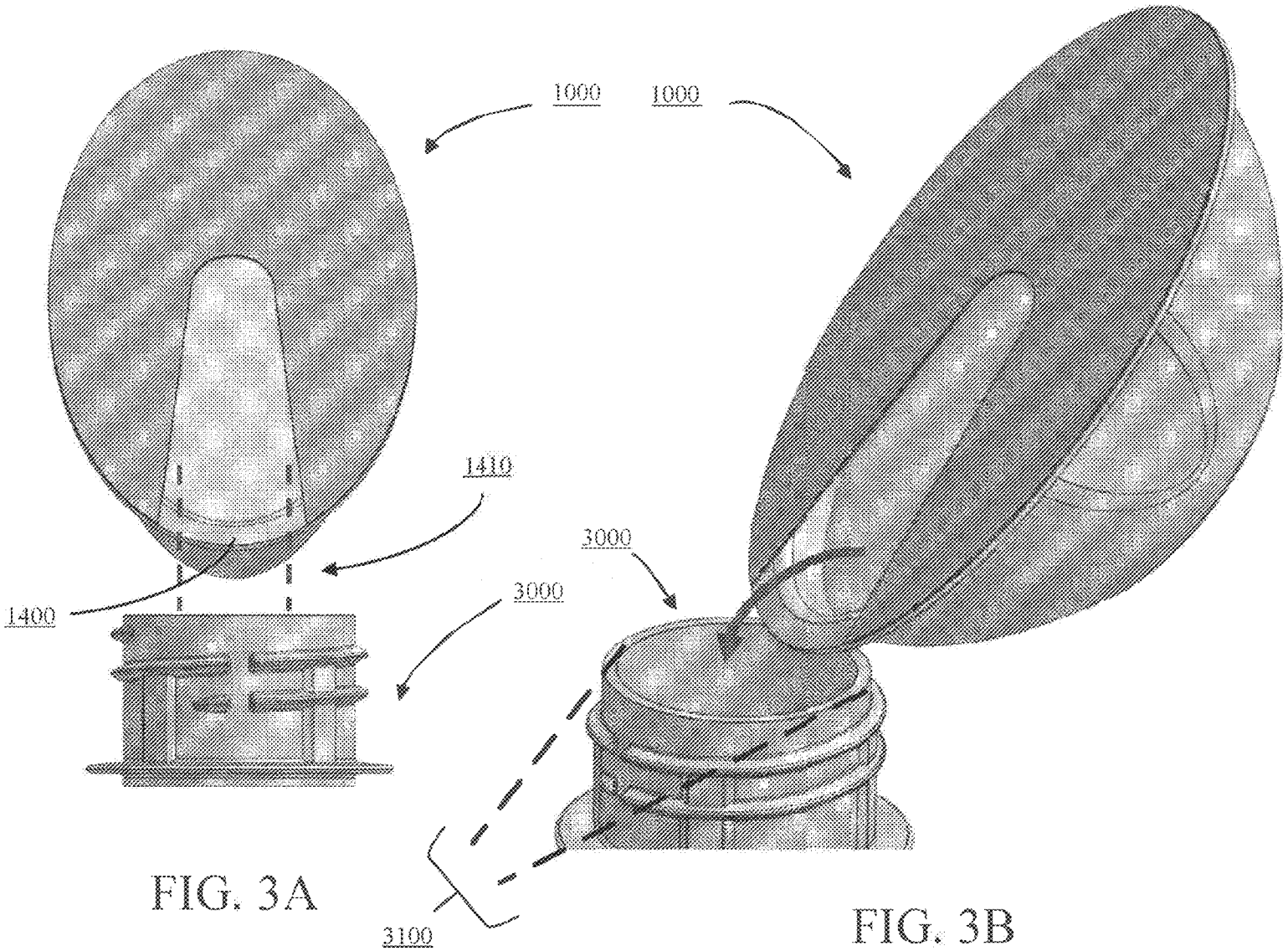
FIGS. 3A and 3B are diagrams of the pod capsule of FIG. 2 in a dispensing state in accordance with implementations.

FIG. 1 is a diagram of a pod capsule 1000 in a sealed state in accordance with implementations. FIG. 2 is a diagram of the pod capsule 1000 in an unsealed state in accordance with implementations. FIGS. 3A and 3B are diagrams of the pod capsule 1000 in a dispensing state proximate to a receiving structure 3000 in accordance with implementations. The pod capsule 1000 includes a pod capsule container 1100 and a lid 1200. The pod capsule 1000 can contain contents 1300.

The pod capsule container 1100 includes a flange 1110 connected to a sidewall 1120, which in turn is connected to a base 1130. The sidewall 1120 includes a pair of opposing guide or grip areas 1122. In implementations, the pair of opposing guide or grip areas 1122 are indented areas in the sidewall 1120. In implementations, the pair of opposing guide or grip areas 1122 are textured for engaging fingers or other extremities of a user. The pair of opposing guide or grip areas 1122 promote correct holding, squeezing, and dispensing of the contents. An interior surface 1124 of the sidewall 1120 and base 1130 (not shown) include a barrier layer 1140.

The lid 1200 includes a retained portion 1210 and removeable portion 1220. The removeable portion 1220 includes a tab portion 1222. In implementations, the tab portion 1222 can be folded around the flange 1110. In implementations, the removeable portion 1220 is defined by perforation lines or tear lines. In implementations, the removeable portion 1220 is a tear away strip. An interior surface 1230 of the lid 1200 includes a barrier layer 1240.

The retained portion 1210 and the removeable portion 1220 substantially overlap the flange 1110. The tab portion 1222 extends past the flange 1110.

A dispensing area 1400 of the pod capsule 1000 is defined by a width of the removeable portion 1220 at the flange 1110. In implementations, the dispensing area 1400 can have a rounded contour. An aperture 1410 at the dispensing area 1400 is substantially defined by an approximate width of the removeable portion 1220 at the flange 1110. The aperture 1410 can be sized to an opening 3100 of a receiving structure 3000. The sizing of the aperture 1410 can prevent or mitigate spillage of the contents during dispensing.

Operationally, the pod capsule container 1100 is filled with the contents 1300. The lid 1200 is fused to the flange 1110 except for the tab portion 1222. A user or consumer can access the contents by pulling on the tab portion 1222 and removing the removeable portion 1220. The user can position fingers on each of the pair of opposing guide or grip areas 1122 and squeeze or pinch to guide, focus, or direct the contents 1300 out through a narrowed dispensing area or deformable contoured dispensing area 1400 and into the receiving structure 3000. In implementations, the squeezing of the pair of opposing guide or grip areas 1122 can release the removeable portion 1220 from the flange 1110 without using the tab portion 1222.

Figure 4:
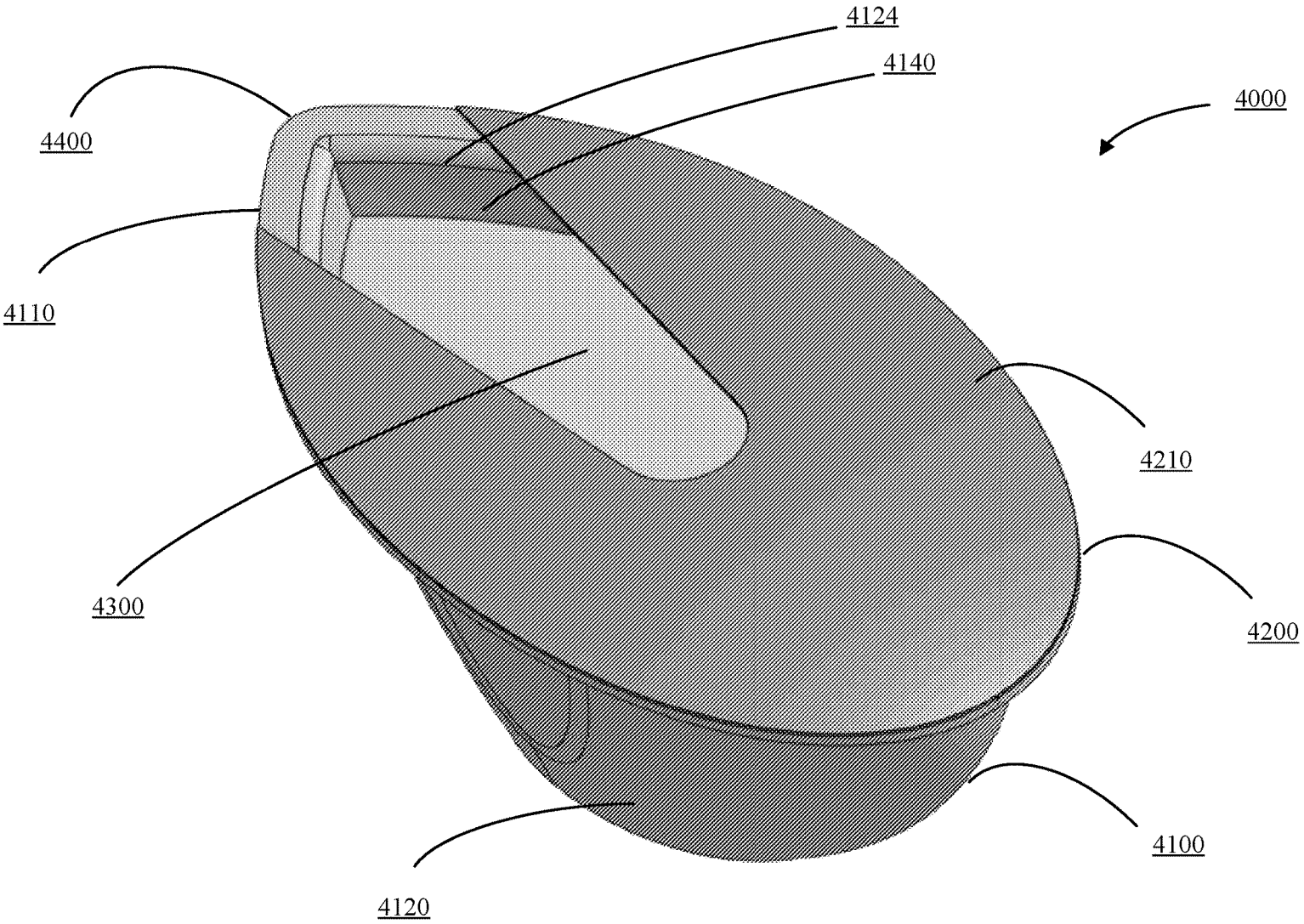
FIG. 4 is a diagram of another pod capsule in an unsealed state in accordance with implementations.
Figures 5A, 5B:
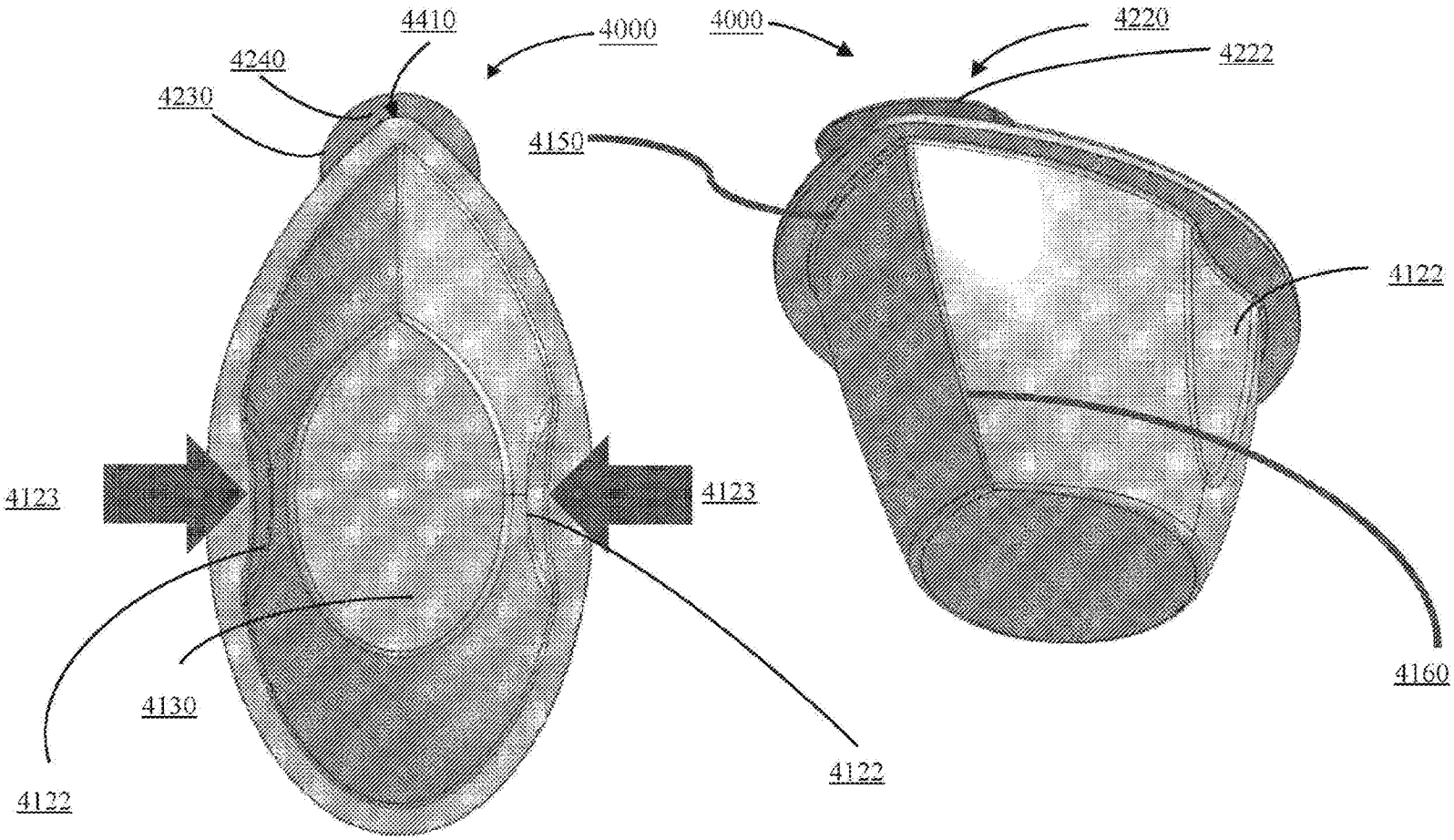
FIGS. 5A and 5B are bottom view diagrams of the pod capsule of FIGS. 4A and 4B in a sealed state in accordance with implementations.

FIG. 4 is a diagram of another pod capsule 4000 in an unsealed state in accordance with implementations. FIGS. 5A and 5B are bottom views of the pod capsule 4000 in a sealed state in accordance with implementations. The pod capsule 4000 includes a pod capsule container 4100 and a lid 4200. The pod capsule 4000 can contain contents 4300.

The pod capsule container 4100 includes a flange 4110 connected to a sidewall 4120, which in turn is connected to a base 4130. The sidewall 4120 includes a pair of opposing guide or grip areas 4122. In implementations, the pair of opposing guide or grip areas 4122 are indented areas in the sidewall 4120. In implementations, the pair of opposing guide or grip areas 4122 are textured for engaging fingers or other extremities of a user. The pair of opposing guide or grip areas 4122 promote correct holding, squeezing, and dispensing of the contents. An interior surface 4124 of the sidewall 4120 and the base 4130 (not shown) include a barrier layer 4140.

The lid 4200 includes a retained portion 4210 and removeable portion 4220. The removeable portion 4220 includes a tab portion 4222. In implementations, the tab portion 4222 can be folded around the flange 4110. In implementations, the removeable portion 4220 is defined by perforation lines or tear lines. In implementations, the removeable portion 4220 is a tear away strip. An interior surface 4230 of the lid 4200 includes a barrier layer 4240.

The retained portion 4210 and the removeable portion 4220 substantially overlap the flange 4110. The tab portion 4222 extends past the flange 4110.

A dispensing area 4400 of the pod capsule 4000 is defined by a width of the removeable portion 4220 at the flange 4110. In implementations, the dispensing area 4400 can have a beak-type or arrow-type contour. The pod capsule container 4100 can include a sharp edge 4150 at a juncture between the flange 4110 and the sidewall 4120 and a crease or sharp edge 4160 at a peak or corner 4410 of the dispensing area 4400 to enable or promote better deformation into a more focused dispensing area. An aperture at the dispensing area 4400 is substantially defined by an approximate width of the removeable portion 4220 at the flange 4110. The aperture 4400 can be sized to an opening of a receiving structure. The sizing of the aperture 4400 can prevent or mitigate spillage of the contents during dispensing.

Operationally, the pod capsule container 4100 is filled with the contents 4300. The lid 4200 is fused to the flange 4110 except for the tab portion 4222. A user or consumer can access the contents by pulling on the tab portion 4222 and removing the removeable portion 4220. The user can position fingers on each of the pair of opposing guide or grip areas 4122 and squeeze or pinch (as shown by arrows 4123) to guide, focus, or direct the contents 4300 out through a narrowed dispensing area 4400 and into the receiving structure. In implementations, the squeezing of the pair of opposing guide or grip areas 4122 can release the removeable portion 4220 from the flange 4110 without using the tab portion 4222.

Figure 6:
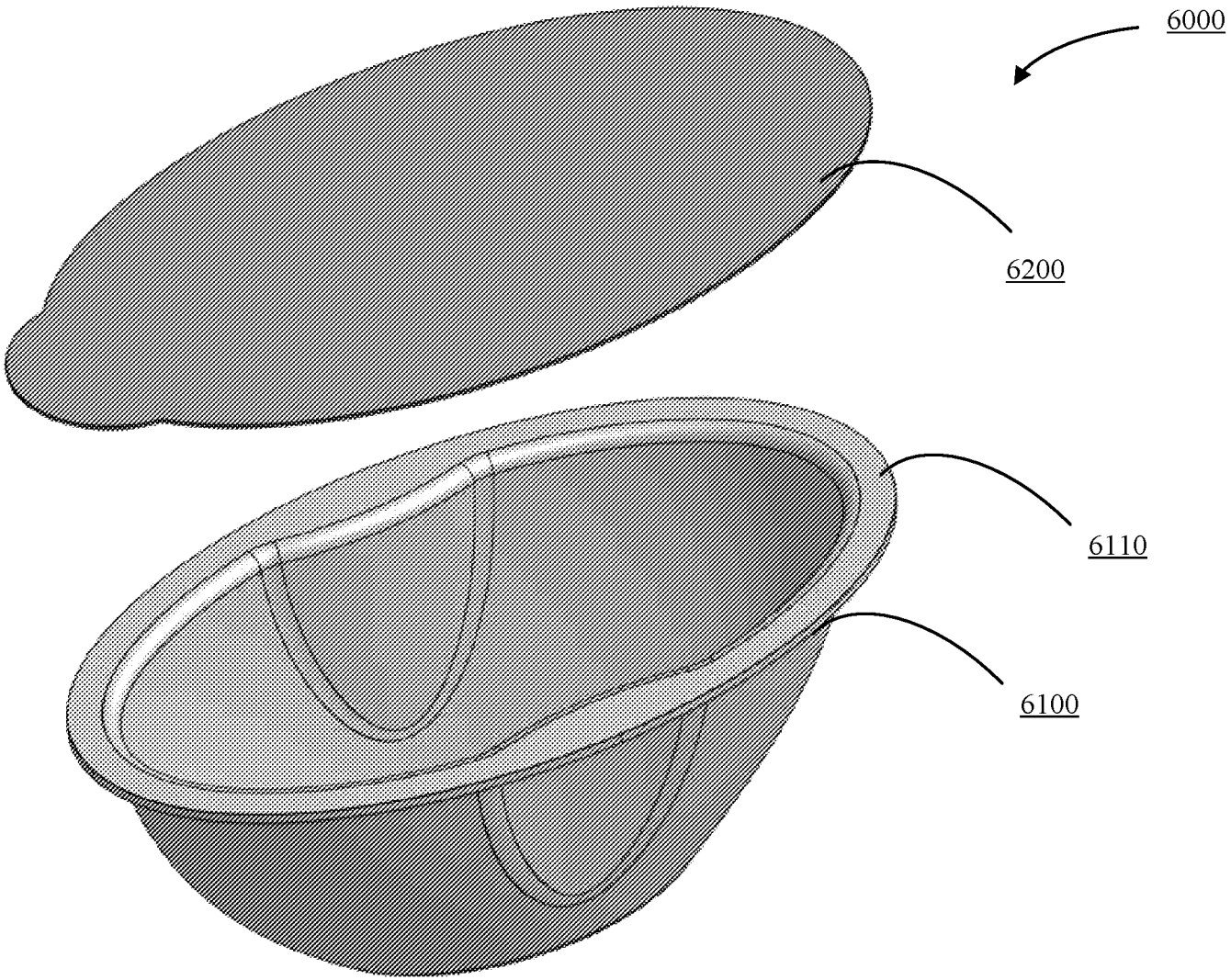
FIG. 6 is a diagram of another pod capsule in accordance with implementations.

FIG. 6 is a diagram of a pod capsule 6000 in accordance with implementations. The pod capsule 6000 is functionally and operationally similar to the pod capsules 1000 and 4000 except as described herein. The pod capsule 6000 includes a pod capsule container 6100 and a lid 6200. The pod capsule container 6100 includes a flange 6110. The lid 6200 can be entirely removeable from the flange 6110 to allow a user access to contents.

Figure 7:
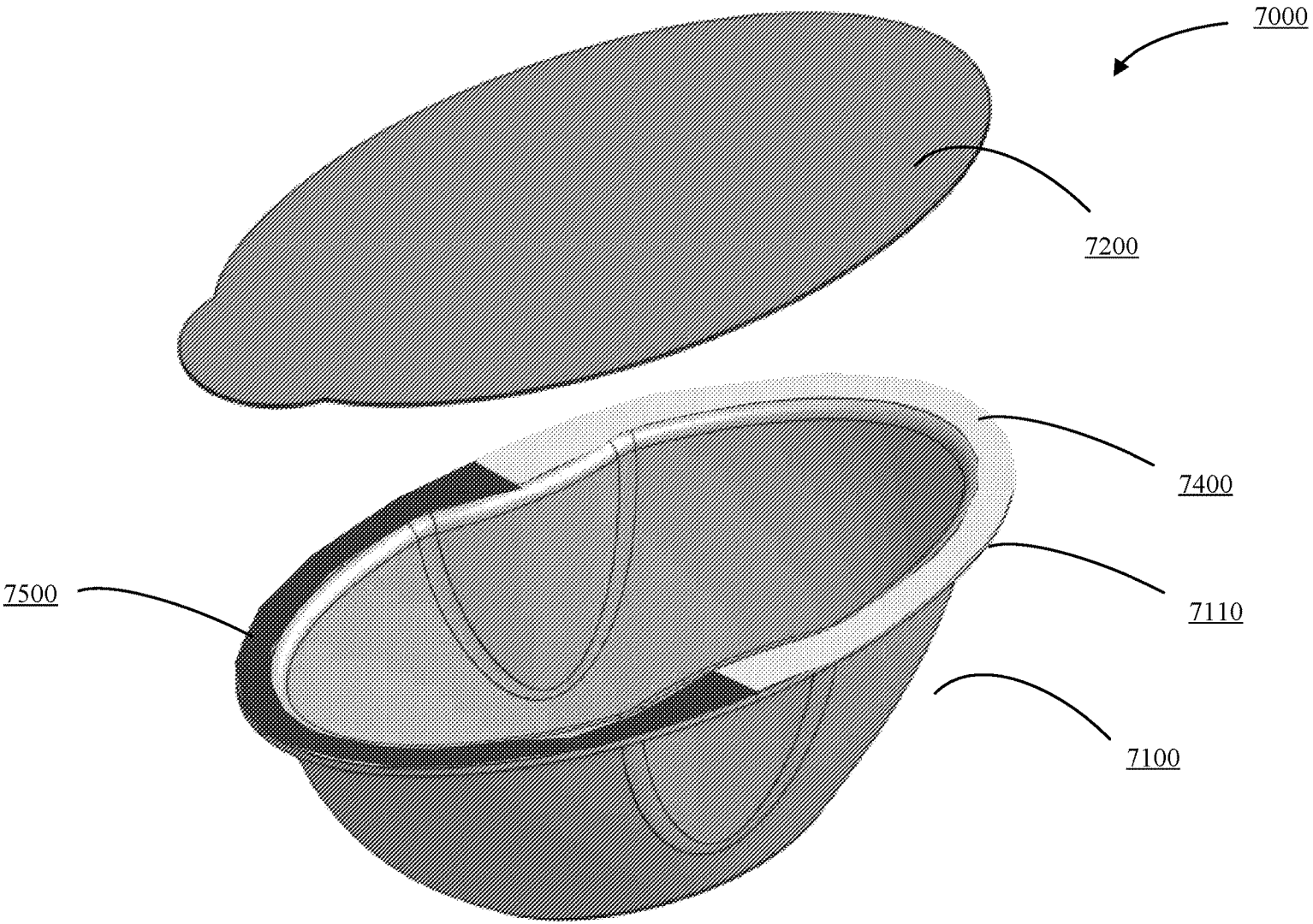
FIG. 7 is a diagram of another pod capsule in accordance with implementations.

FIG. 7 is a diagram of a pod capsule 7000 in accordance with implementations. The pod capsule 7000 is functionally and operationally similar to the pod capsules 1000 and 4000 except as described herein. The pod capsule 7000 includes a pod capsule container 7100 and a lid 7200. The pod capsule container 7100 includes a flange 7110. The lid 7200 can be fused to the flange 7110 using different strength adhesives. A strong adhesive 7400 can be used between one section of the lid 7200 and the flange 7110 and a weak adhesive 7500 can be used between another section of the lid 7200 and the flange 7110. The use of different strength adhesives preferentially create a dispensing area when squeezed as described herein.

Figure 8:
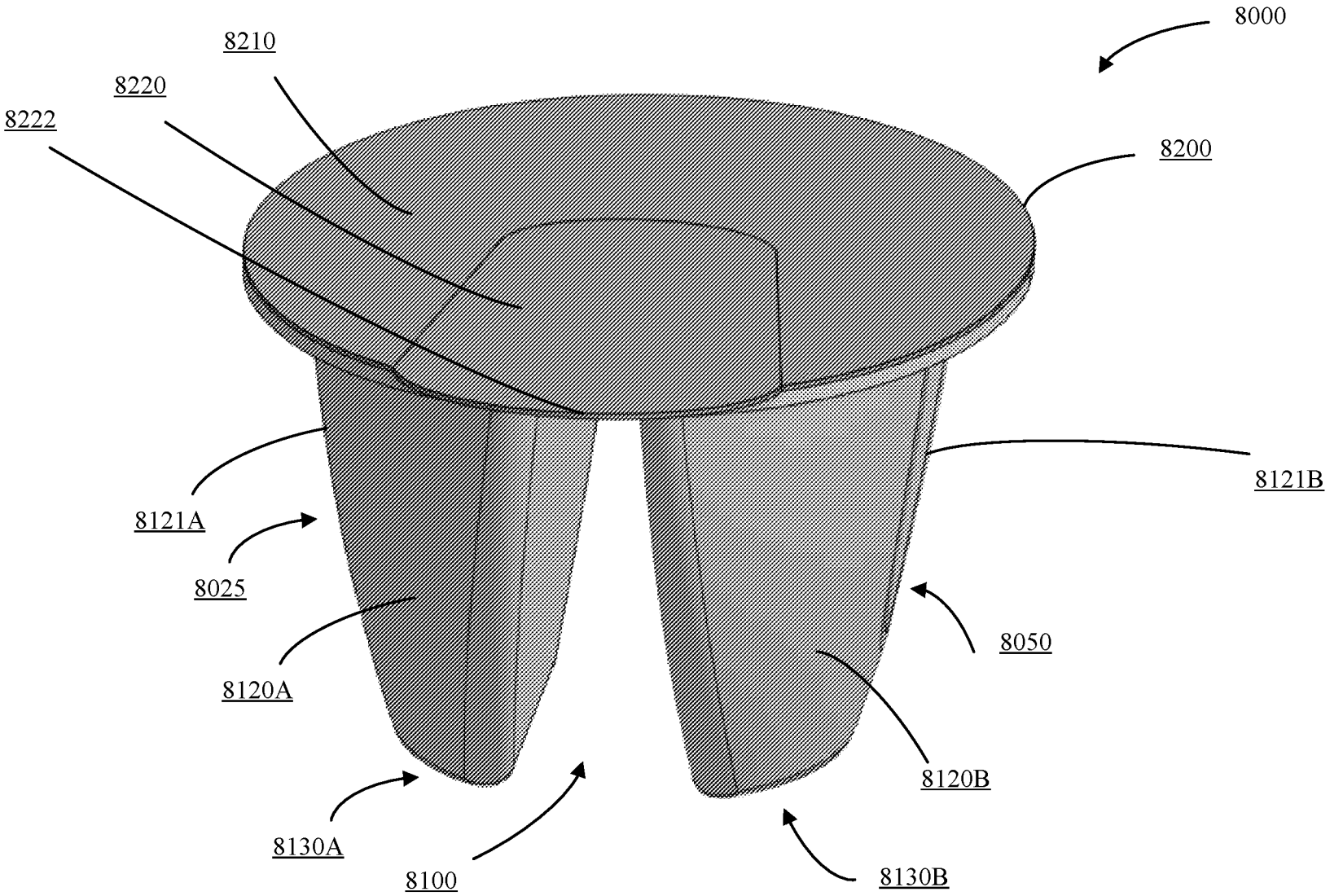
FIG. 8 is a diagram of another pod capsule in a sealed state in accordance with implementations.
Figure 9B:
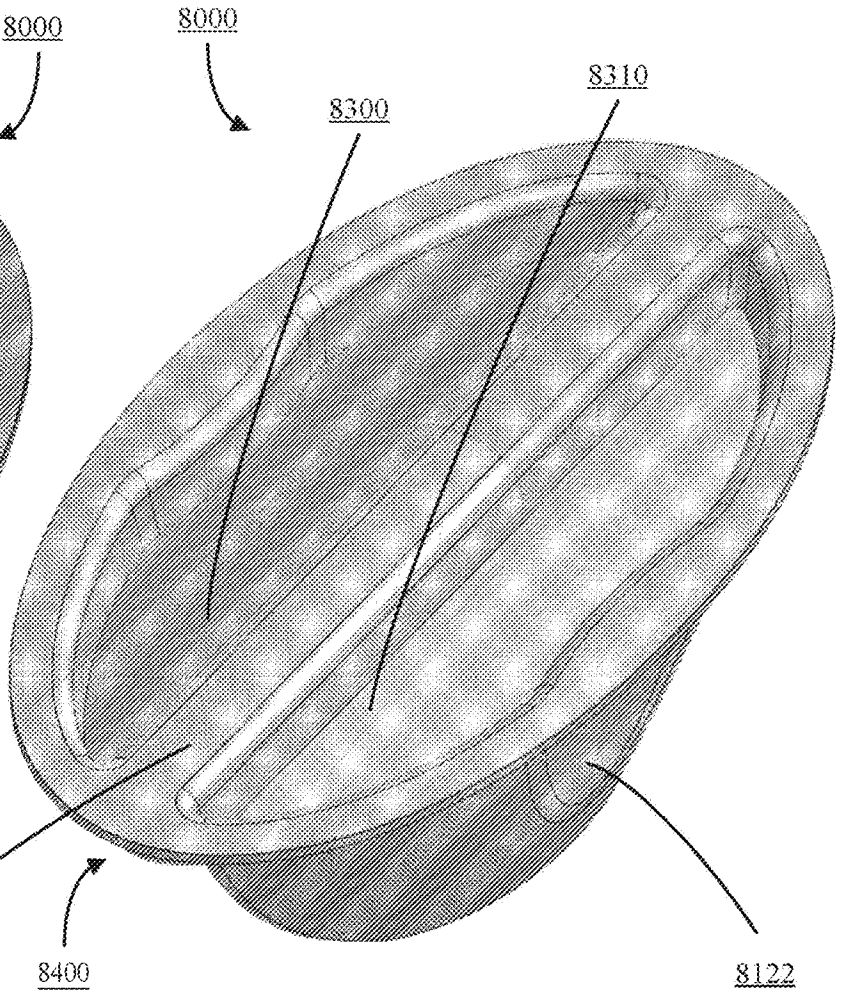
FIGS. 9A and 9B are diagrams of the pod capsule of FIG. 8 in an unsealed state in accordance with implementations.
Figure 9A:
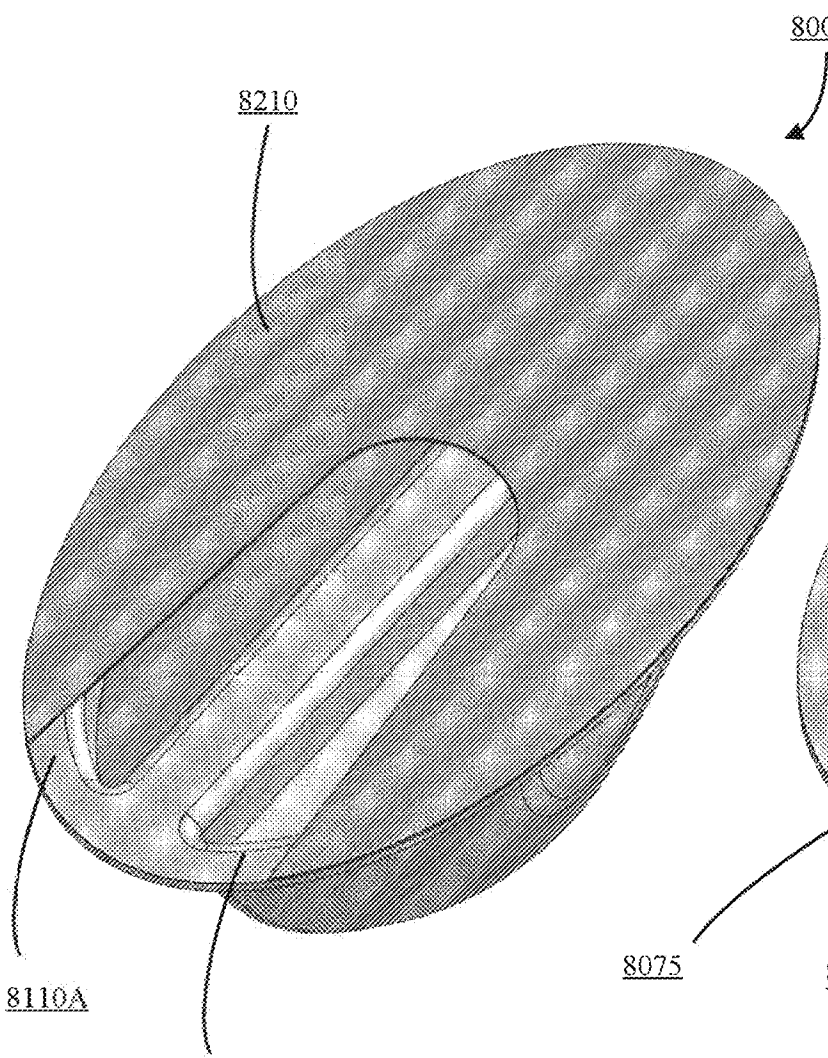

FIG. 8 is a diagram of a pod capsule 8000 in a sealed state in accordance with implementations. FIG. 9A is a diagram of the pod capsule 8000 in an unsealed state in accordance with implementations and FIG. 9B is a diagram with a transparent lid for purposes of illustrating the two different contents. The pod capsule 8000 is functionally and operationally similar to the pod capsules 1000, 4000, 6000, and 7000 except as described herein. The pod capsule 8000 includes a pod capsule container 8100 and a lid 8200.

The pod capsule container 8100 can include two dispensing chambers 8025 and 8050. In implementations, the pod capsule container 8000 can include multiple chambers. Each of the dispensing chambers 8025 and 8050 can include different contents 8300 and 8310, respectively. For example, the contents can be mixed or combined during and after dispensing from the pod capsule 8000. The dispensing chambers 8025 and 8050 are interconnected via bridge section 8075. The dispensing chamber 8025 includes a flange 8110A connected to the bridge section 8075 and a sidewall 8120A, which in turn is connected to a base 8130A. The dispensing chamber 8050 includes a flange 8110B connected to the bridge section 8075 and a sidewall 8120B, which in turn is connected to a base 8130B. An external sidewall 8121A and external sidewall 8121B includes a pair of opposing guide or grip areas 8122. In implementations, the pair of opposing guide or grip areas 8122 are indented areas in the external sidewall 8121A and the external sidewall 8121B. In implementations, the pair of opposing guide or grip areas 8122 are textured for engaging fingers or other extremities of a user. The pair of opposing guide or grip areas 8122 promote correct holding, squeezing, and dispensing of the contents. As described herein, interior surfaces of the two dispensing chambers 8025 and 8050 include barrier layer.

The lid 8200 includes a retained portion 8210 and removeable portion 8220. The removeable portion 8220 includes a tab portion 8222. In implementations, the tab portion 8222 can be folded around the flange 8110A and/or 8110B. In implementations, the removeable portion 8220 is defined by perforation lines or tear lines. In implementations, the removeable portion 8220 is a tear away strip. As described herein, an interior surface of the lid 8200 includes a barrier layer.

The retained portion 8210 and the removeable portion 8220 substantially overlap the flange 8110A and 8110B. The tab portion 8222 extends past the flange 8110A and 8110B.

A dispensing area 8400 of the pod capsule 8000 is defined by a width of the removeable portion 8220 at the flange 8110A and 8110B. In implementations, the dispensing area 8400 can have a rounded contour, a beak-type contour, and other dispensing shape. An aperture at the dispensing area 8400 is substantially defined by an approximate width of the removeable portion 8220 at the flange 8110A and 8110B. The aperture can be sized to an opening of a receiving structure. The sizing of the aperture can prevent or mitigate spillage of the contents during dispensing.

Operationally, each of the dispensing chambers 8025 and 8050 is filled with the contents 8300 and 8310, respectively. The lid 8200 is fused to the flange 8110A and 8110B and the bridge section 8075 except for the tab portion 8222. A user or consumer can access the contents by pulling on the tab portion 8222 and removing the removeable portion 1220. The user can position fingers on each of the pair of opposing guide or grip areas 1122 and squeeze or pinch to guide, focus, or direct the contents 8300 and 8310 out through a narrowed dispensing area 8400 and into the receiving structure. In implementations, the squeezing of the pair of opposing guide or grip areas 8122 can release the removeable portion 8220 from the flange 8110A and 8110B without using the tab portion 8222.

The pod capsules described herein can be formed individually or an in interconnected web format for filling, sealing, merchandising, and sales. In implementations, perforations in the interconnected web format are provided to separate individual pod capsules.

Figure 10:
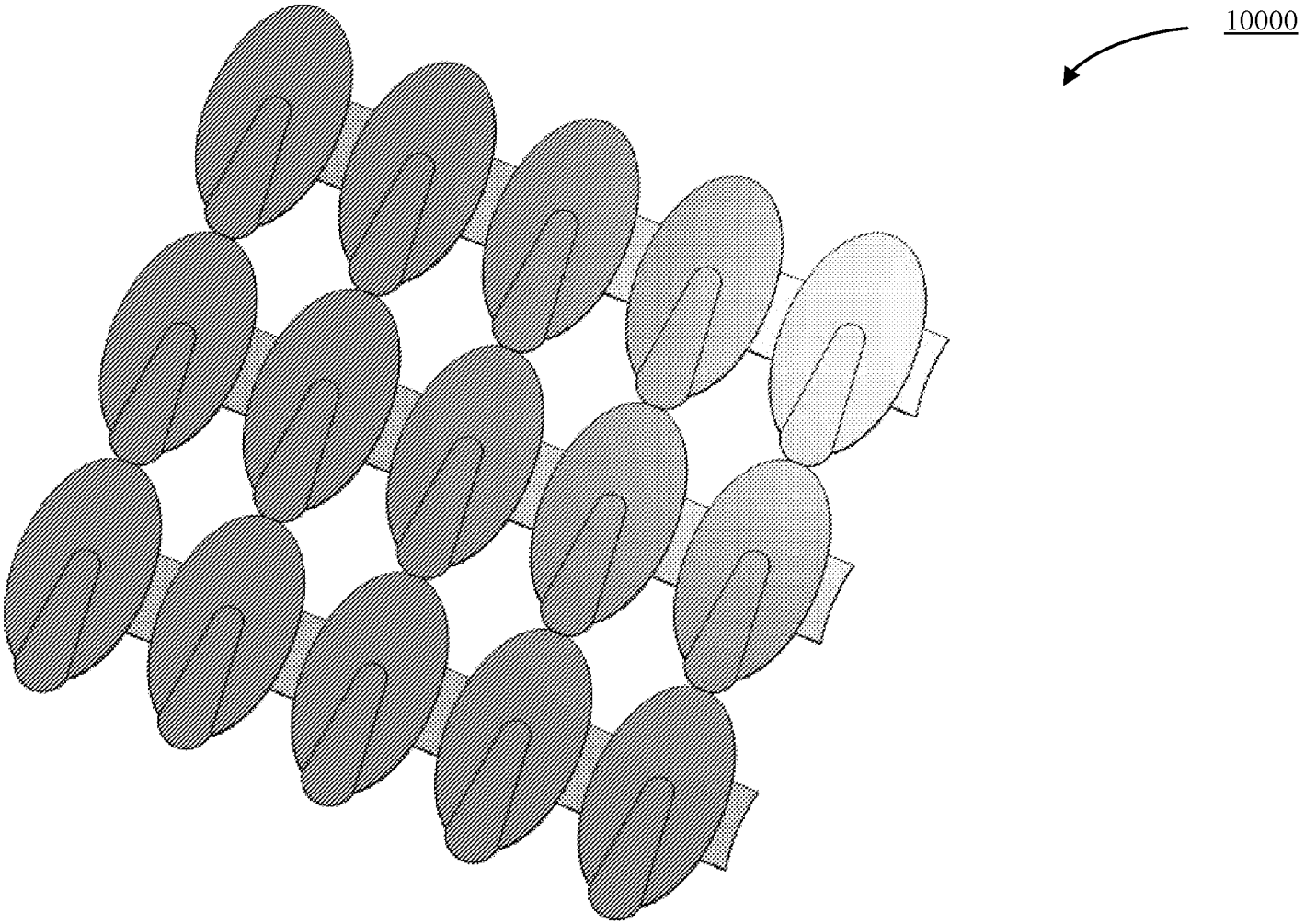
FIG. 10 is a diagram of a sheet of pod capsule lids in accordance with implementations.

FIG. 10 is a diagram of an interconnected web format or sheet of pod capsule lids 10000 in accordance with implementations. The sheet of pod capsule lids 10000 can contain an array of pod capsule lids which are separated by perforation lines for individual separation.

Figure 11:
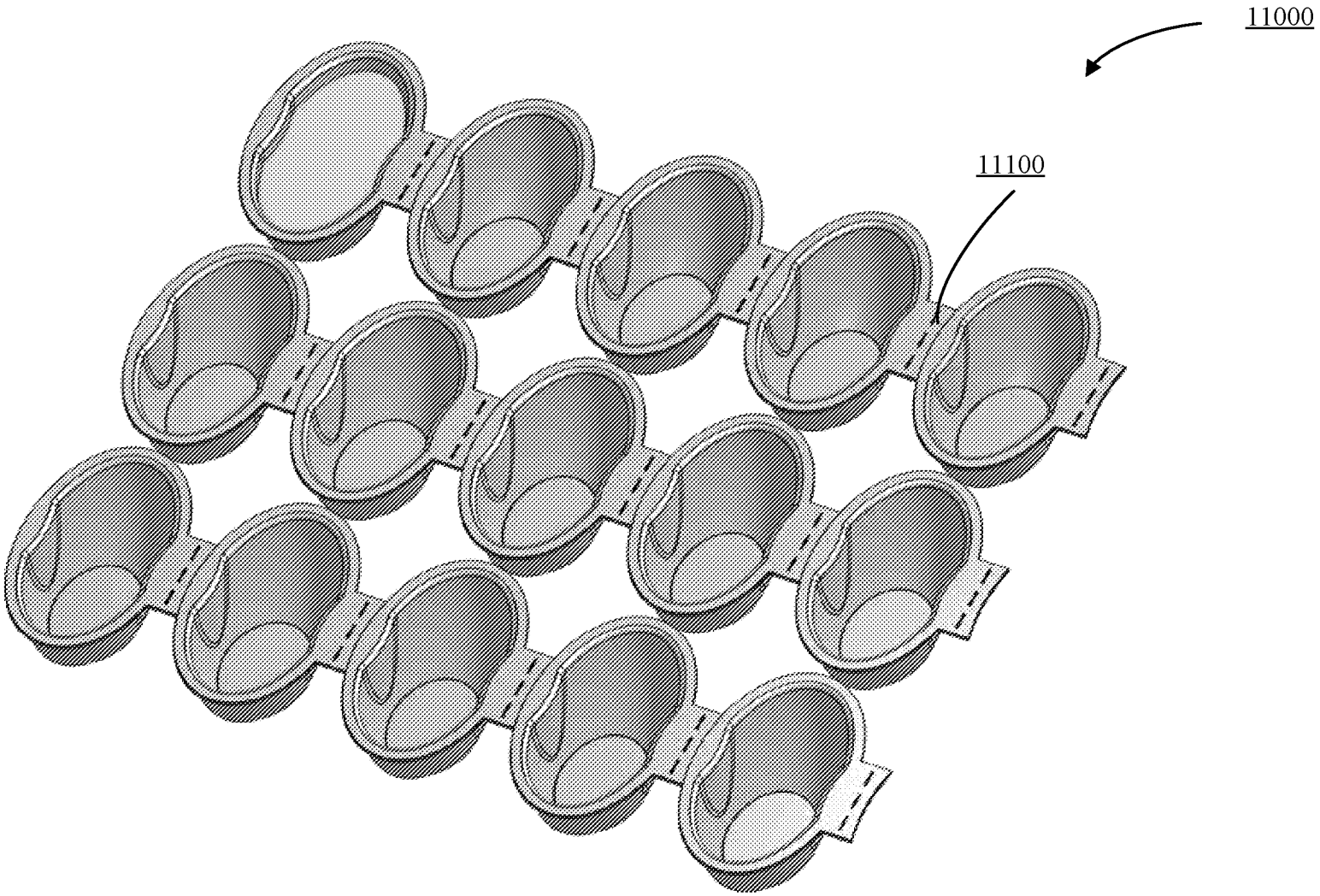
FIG. 11 is a diagram of a sheet of pod capsule containers in accordance with implementations.

FIG. 11 is a diagram of a sheet of pod capsule containers 11000 in accordance with implementations. The sheet of pod capsule containers 11000 can contain an array of pod capsule containers which are separated by perforation lines 11100 for individual separation.

Figure 12:
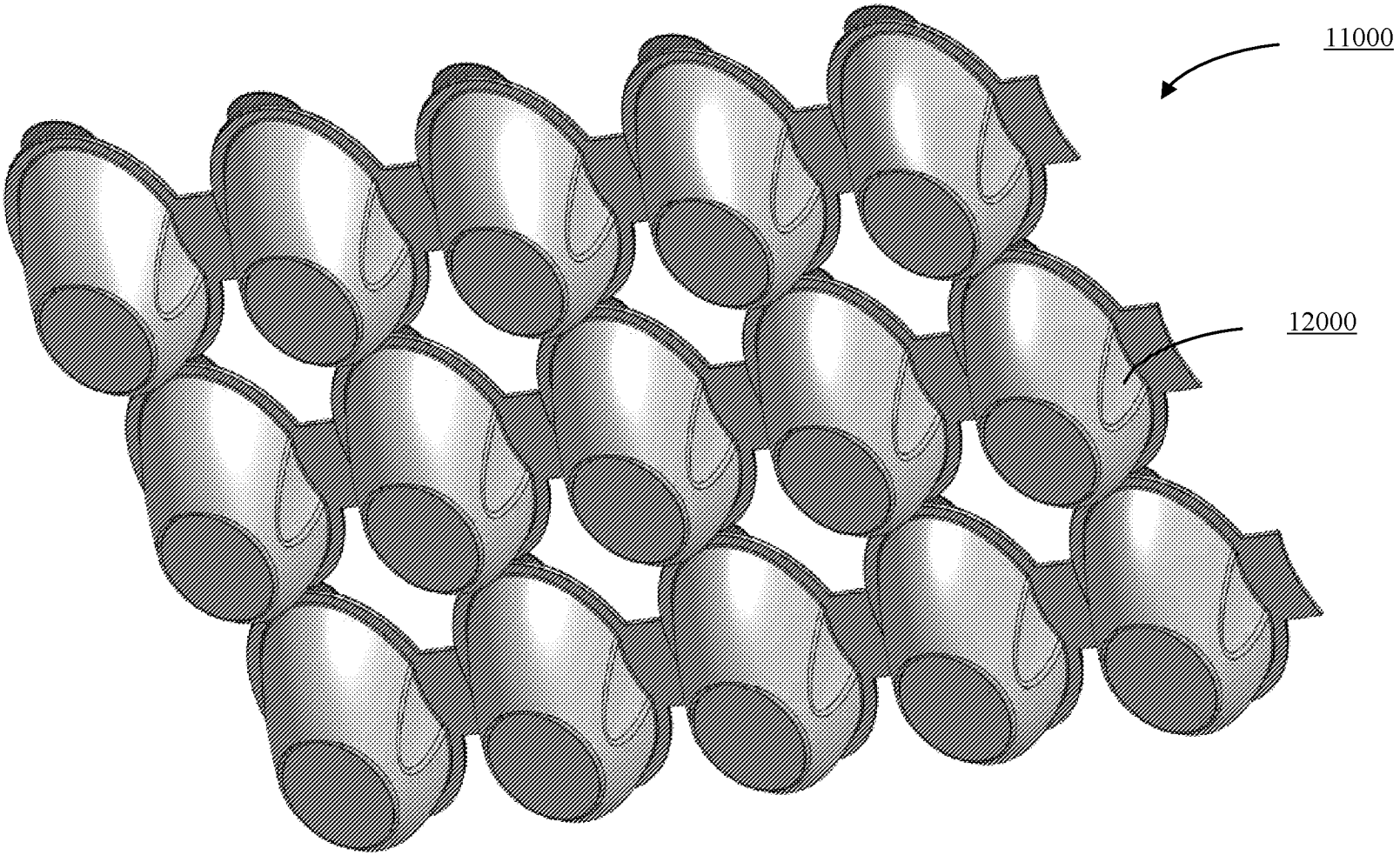
FIG. 12 is a bottom view of the sheet of pod capsule containers of FIG. 11 in accordance with implementations.

FIG. 12 is a bottom view of the sheet of pod capsule containers 11000 in accordance with implementations. Guide or grip areas 12000 are illustrated on each pod capsule container.

Figure 13:
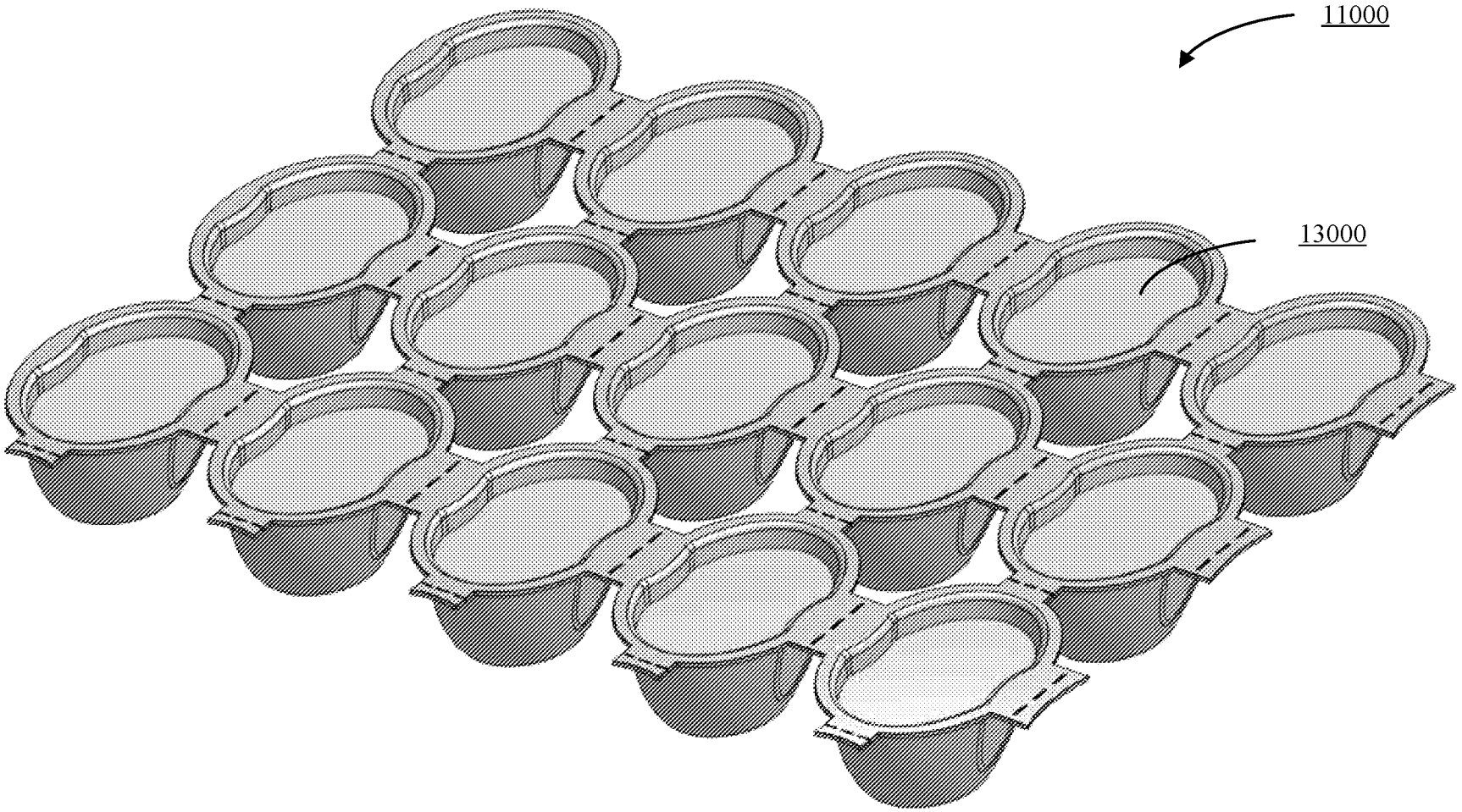
FIG. 13 is a diagram of the sheet of pod capsule containers of FIG. 11 filled with contents in accordance with implementations.

FIG. 13 is a diagram of the sheet of pod capsule containers 11000 filled with contents 13000 in accordance with implementations.

Figure 14:
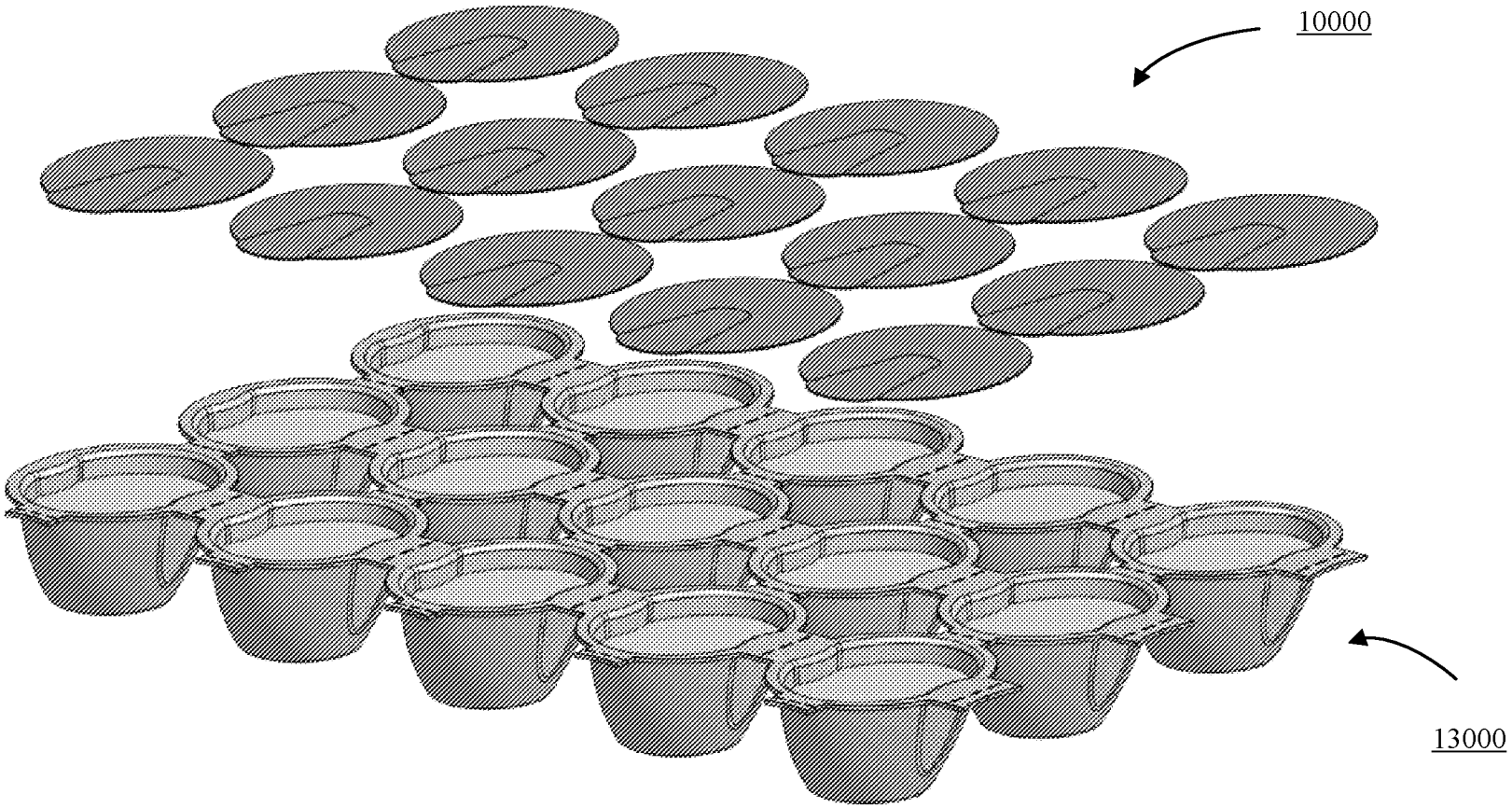
FIG. 14 is a diagram juxtaposing pod capsule lids with the sheet of pod capsule containers of FIG. 13 in accordance with implementations.

FIG. 14 is a diagram juxtaposing separated pod capsule lids for fusing with the sheet of pod capsule containers 11000 which are filled with contents 13000 in accordance with implementations. In implementations, the sheet of pod capsule lids 10000 can be collectively fused to the sheet of pod capsule containers 11000 which are filled with contents 13000.

Figure 15A:
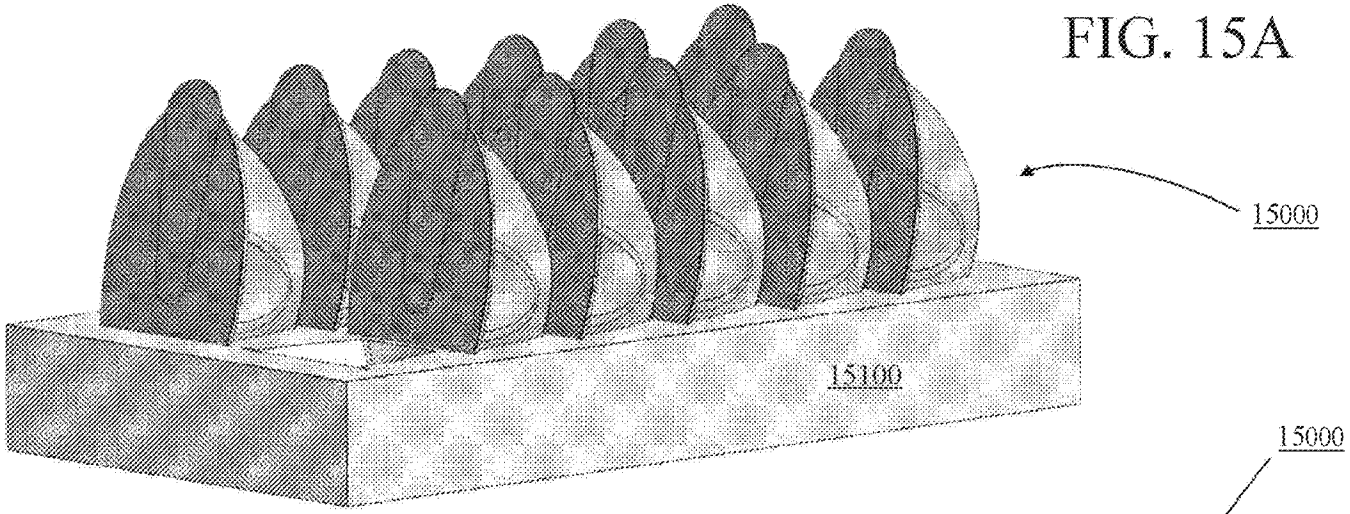
FIGS. 15A and 15B are diagrams of separated pod capsules in accordance with implementations.
Figure 15B:
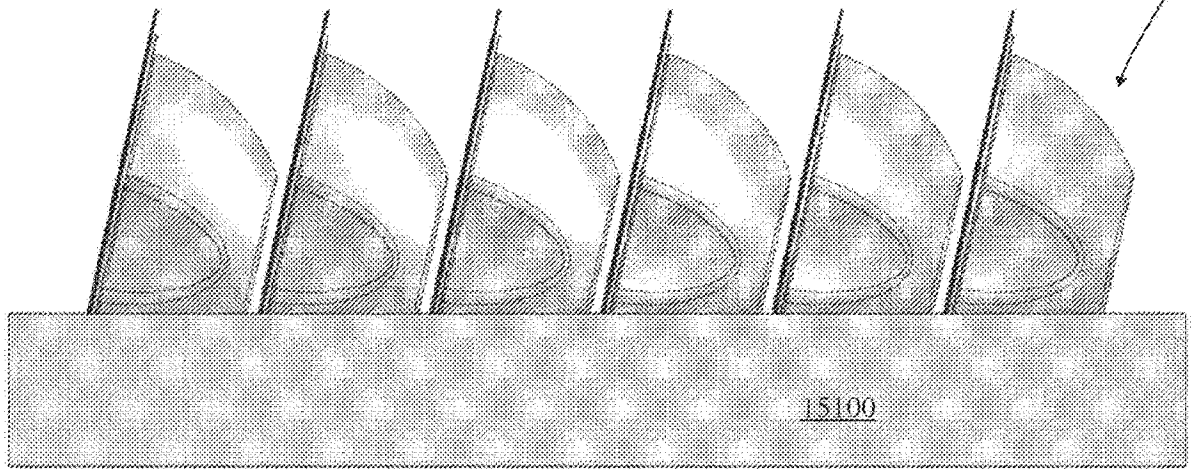

FIGS. 15A and 15B are diagrams of separated pod capsules 15000 in accordance with implementations. After fusing the pod capsule lids with the sheet of pod capsule containers 11000 which are filled with contents 13000, individual pod capsules 15000 can be separated and shown in a display stand 15100.

Figure 16:
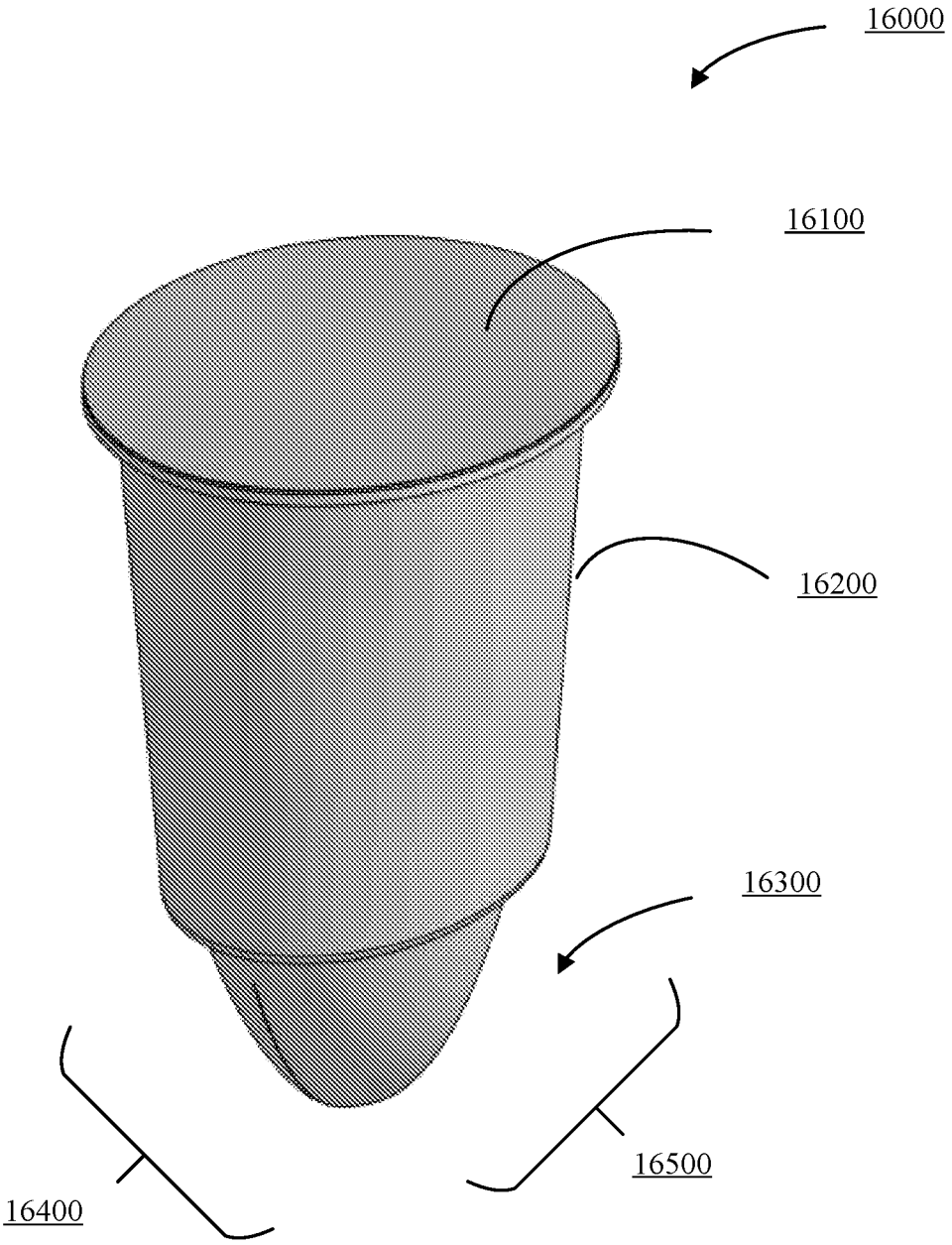
FIG. 16 is a diagram of another pod capsule in a sealed state in accordance with implementations.
Figure 17:
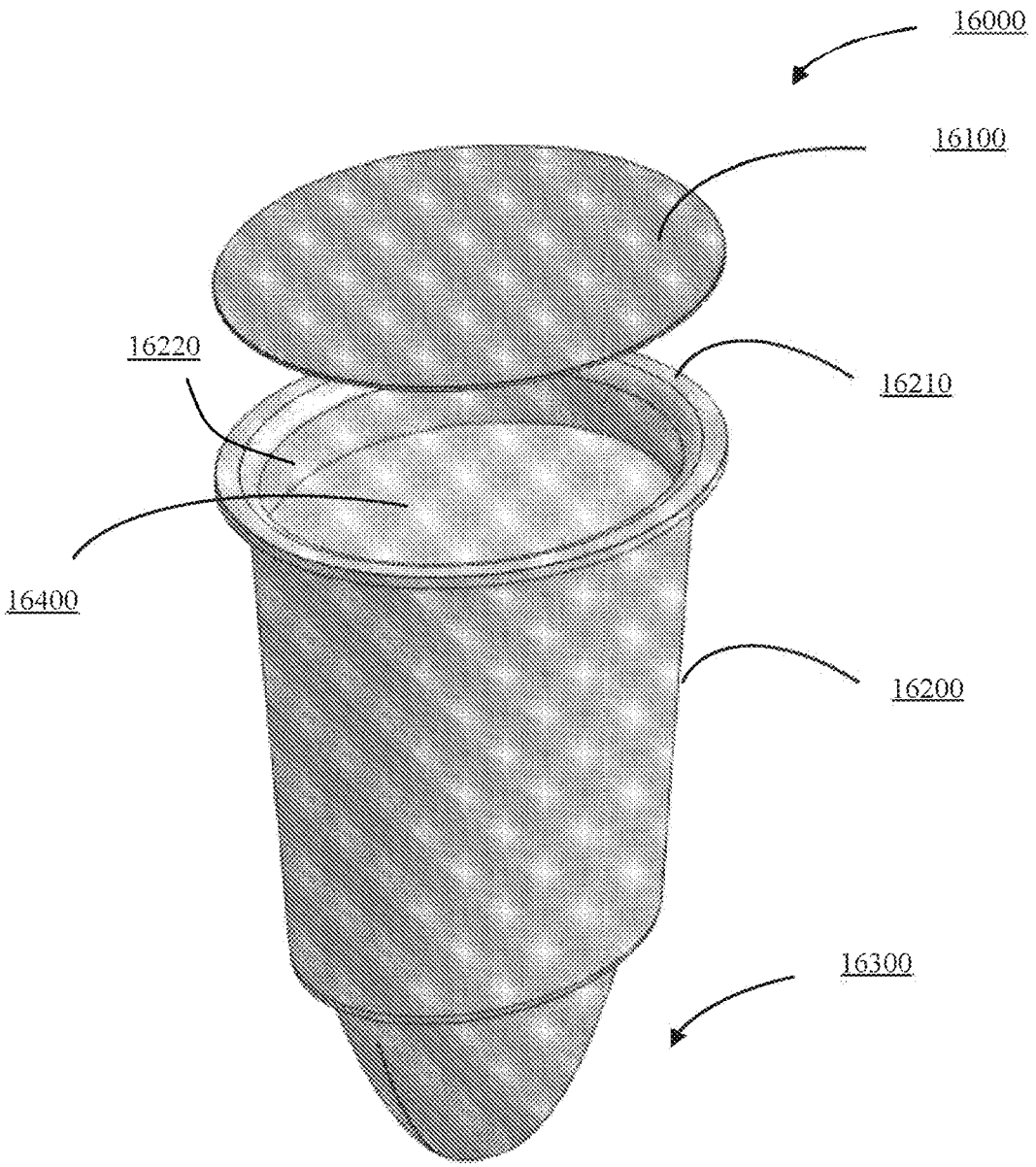
FIG. 17 is an exploded view of the pod capsule of FIG. 16 in accordance with implementations.
Figure 18:
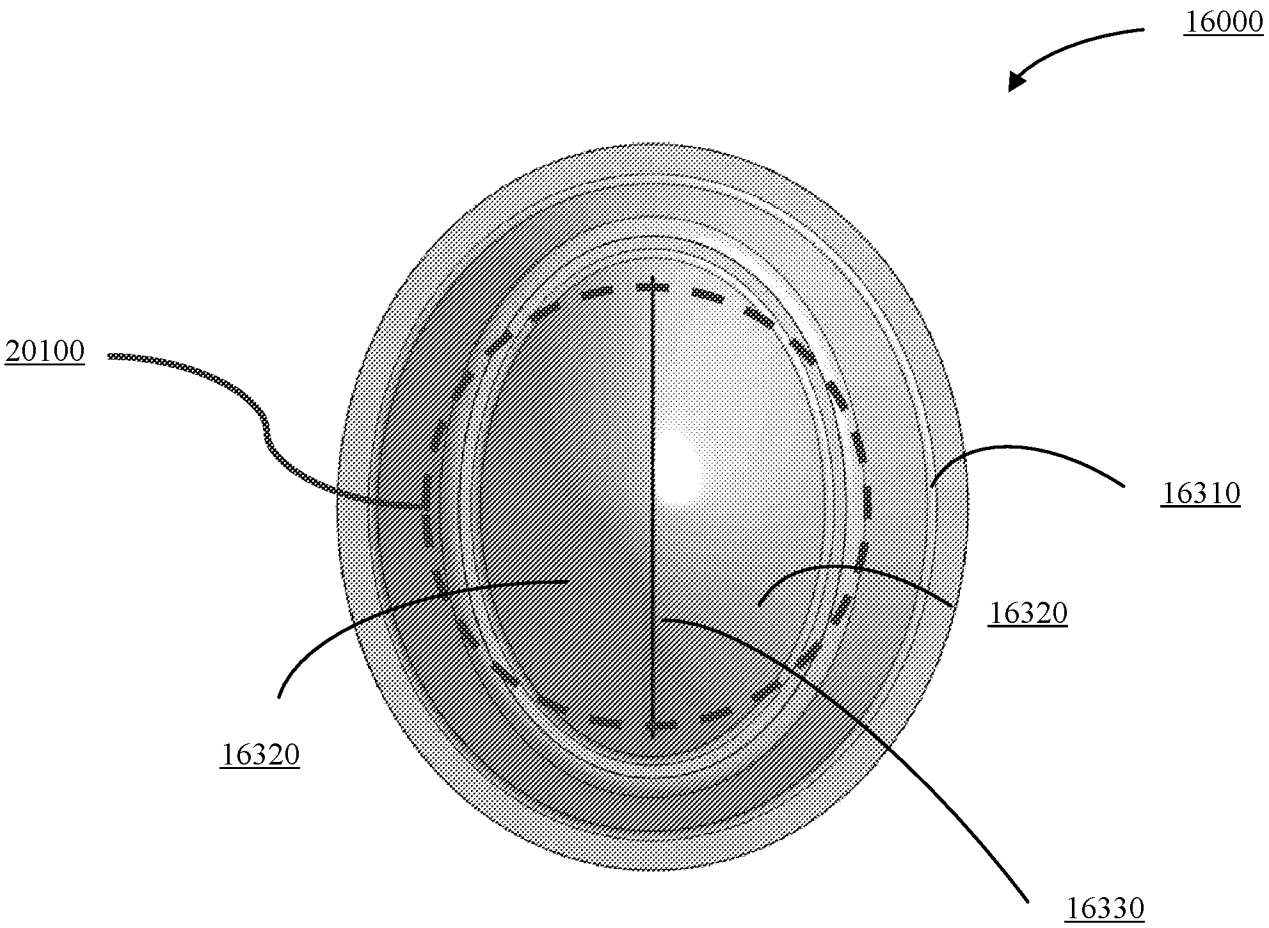
FIG. 18 is a bottom view of the pod capsule of FIG. 16 in a closed state in accordance with implementations.
Figure 19:
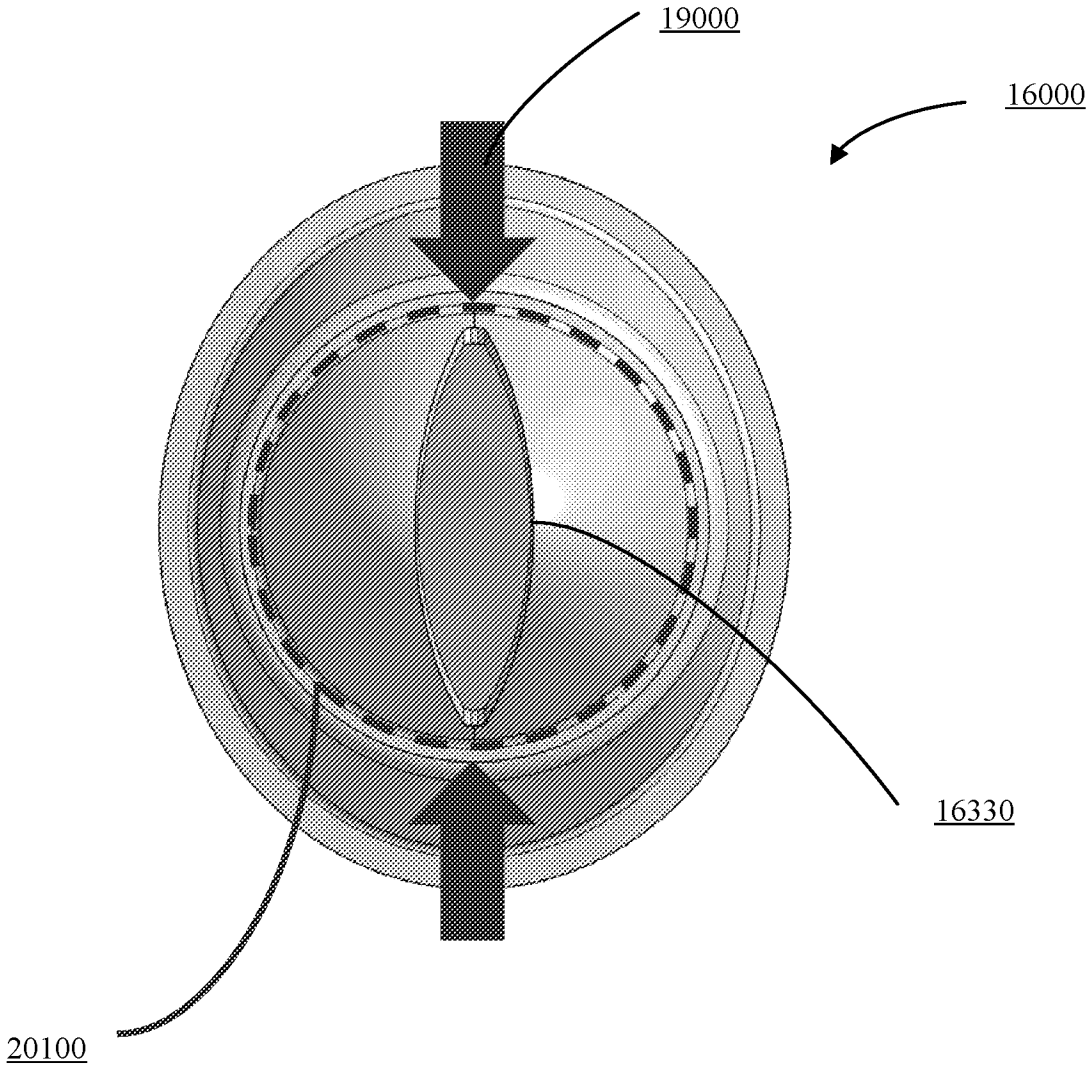
FIG. 19 is a bottom view of the pod capsule of FIG. 16 in an open state in accordance with implementations.
Figure 20:
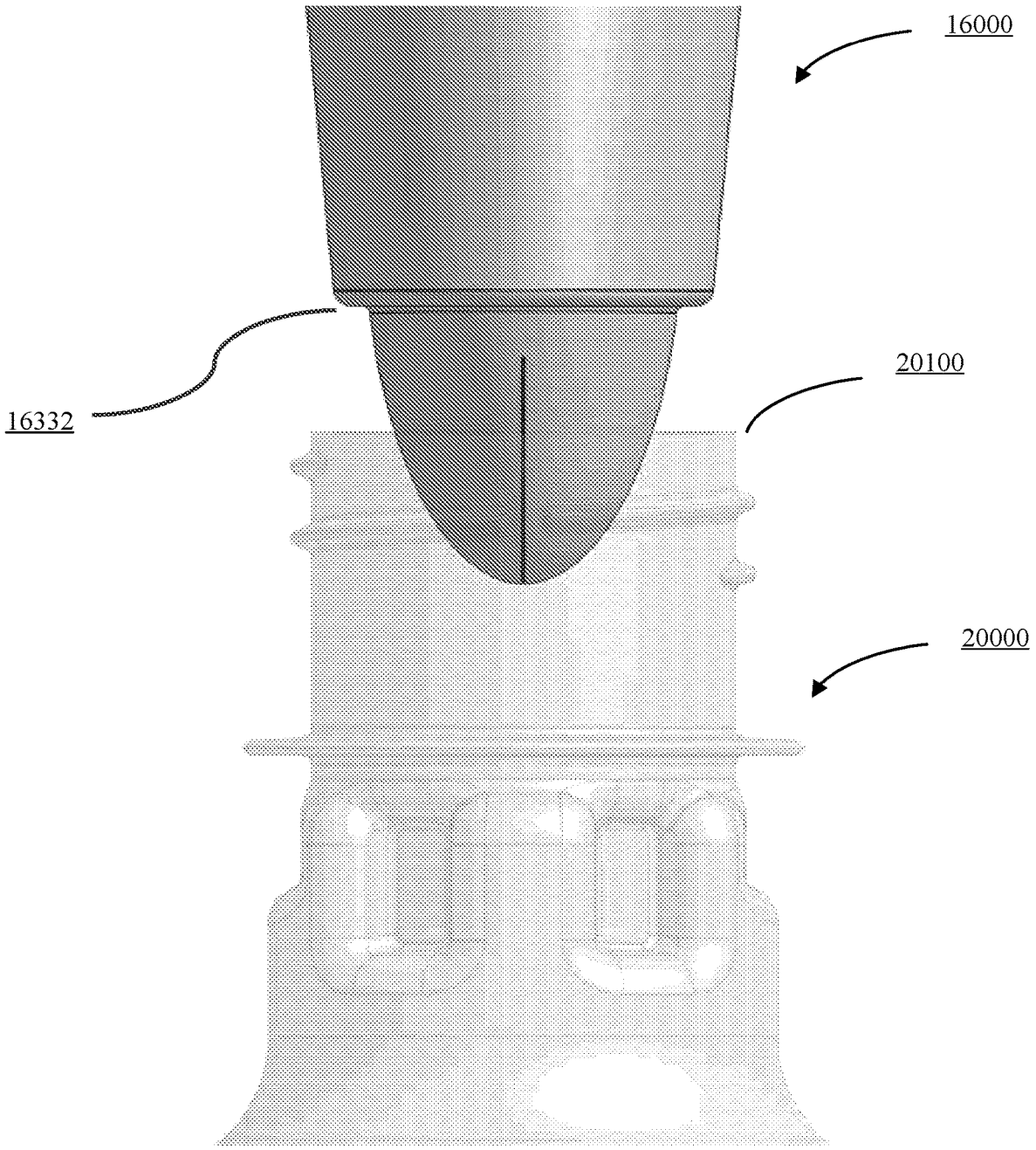
FIG. 20 is a diagram juxtaposing the pod capsule of FIG. 16 with a receiving structure in a pre-insertion state in accordance with implementations.
Figure 21:
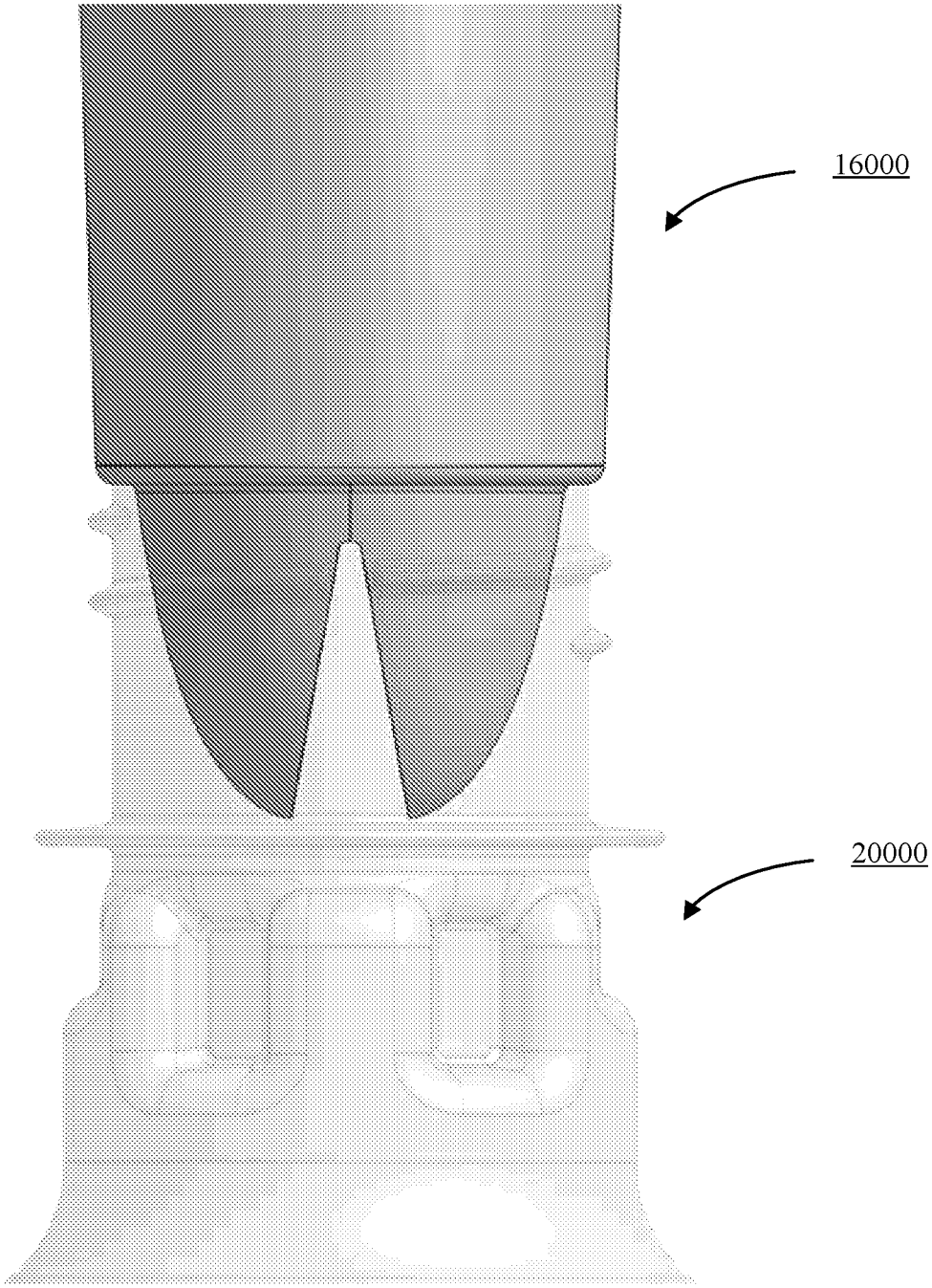
FIG. 21 is a diagram juxtaposing the pod capsule of FIG. 16 with a receiving structure in an insertion state in accordance with implementations.
Figure 22:
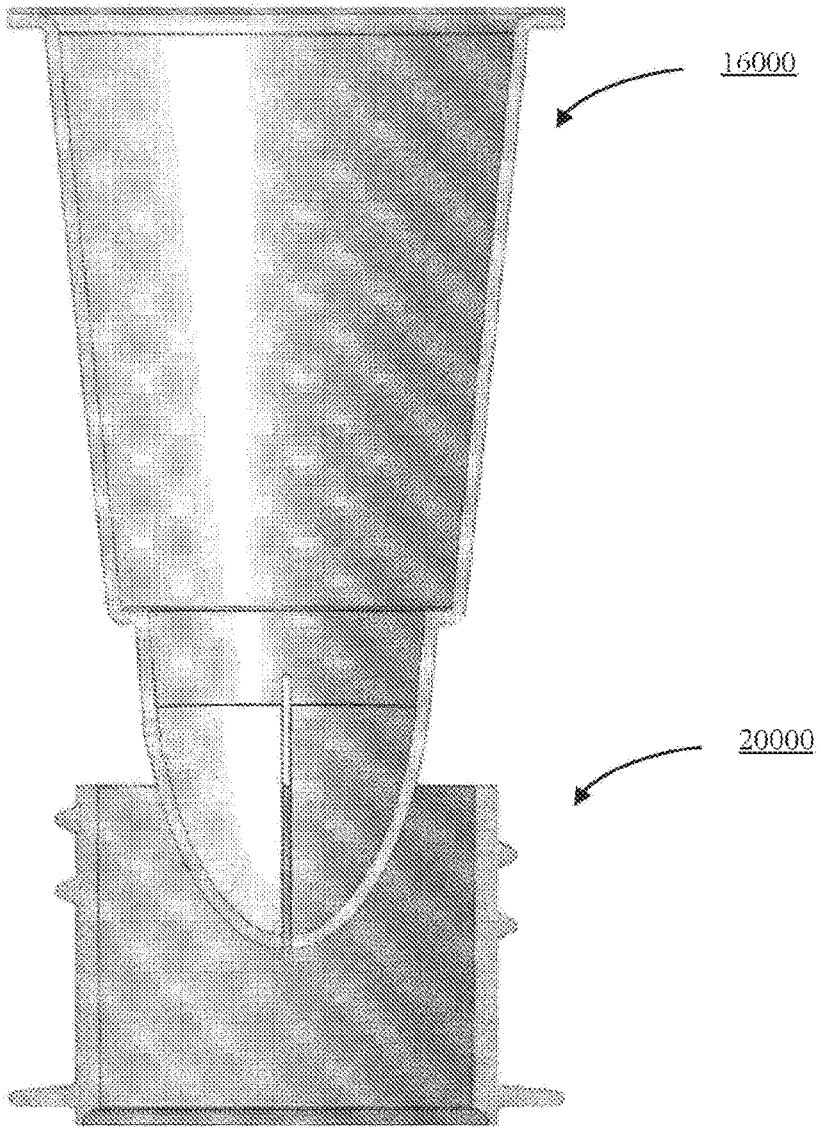
FIG. 22 is a cross-sectional view along a short axis juxtaposing the pod capsule of FIG. 16 with a receiving structure in a pre-insertion state in accordance with implementations.
Figure 23:
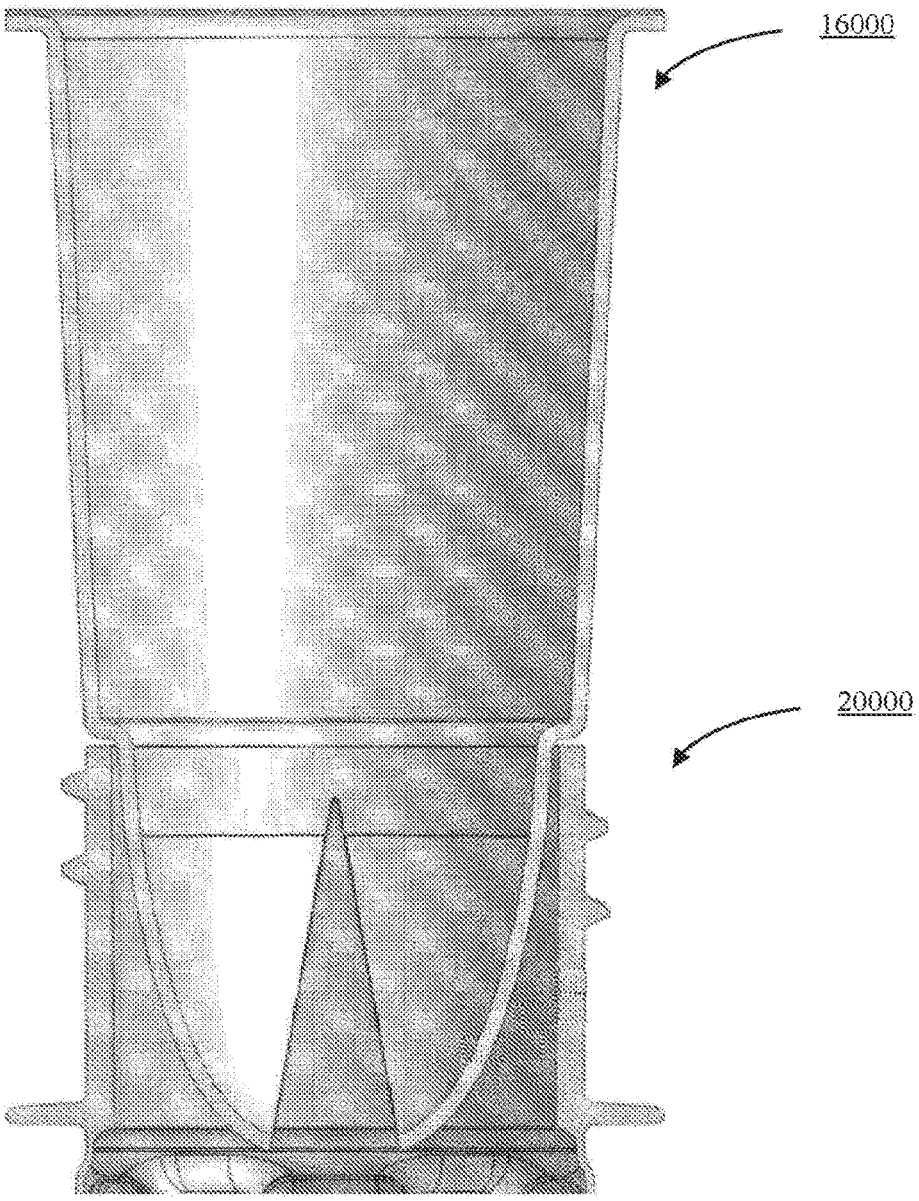
FIG. 23 is a cross-sectional view along a short axis juxtaposing the pod capsule of FIG. 16 with a receiving structure in an insertion state in accordance with implementations.
Figure 24:
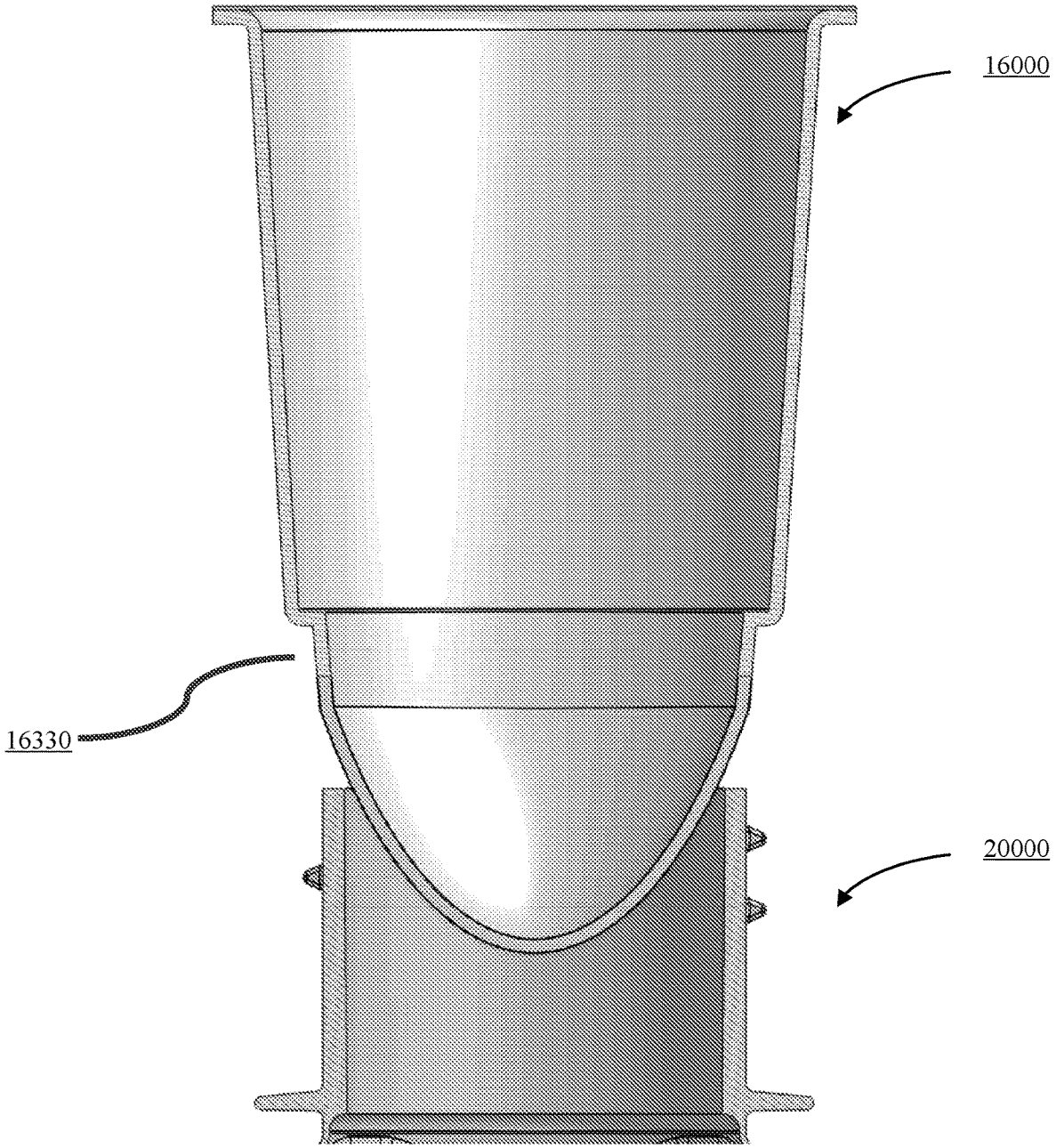
FIG. 24 is a cross-sectional view along a long axis juxtaposing the pod capsule of FIG. 16 with a receiving structure in a pre-insertion state in accordance with implementations.
Figure 25:
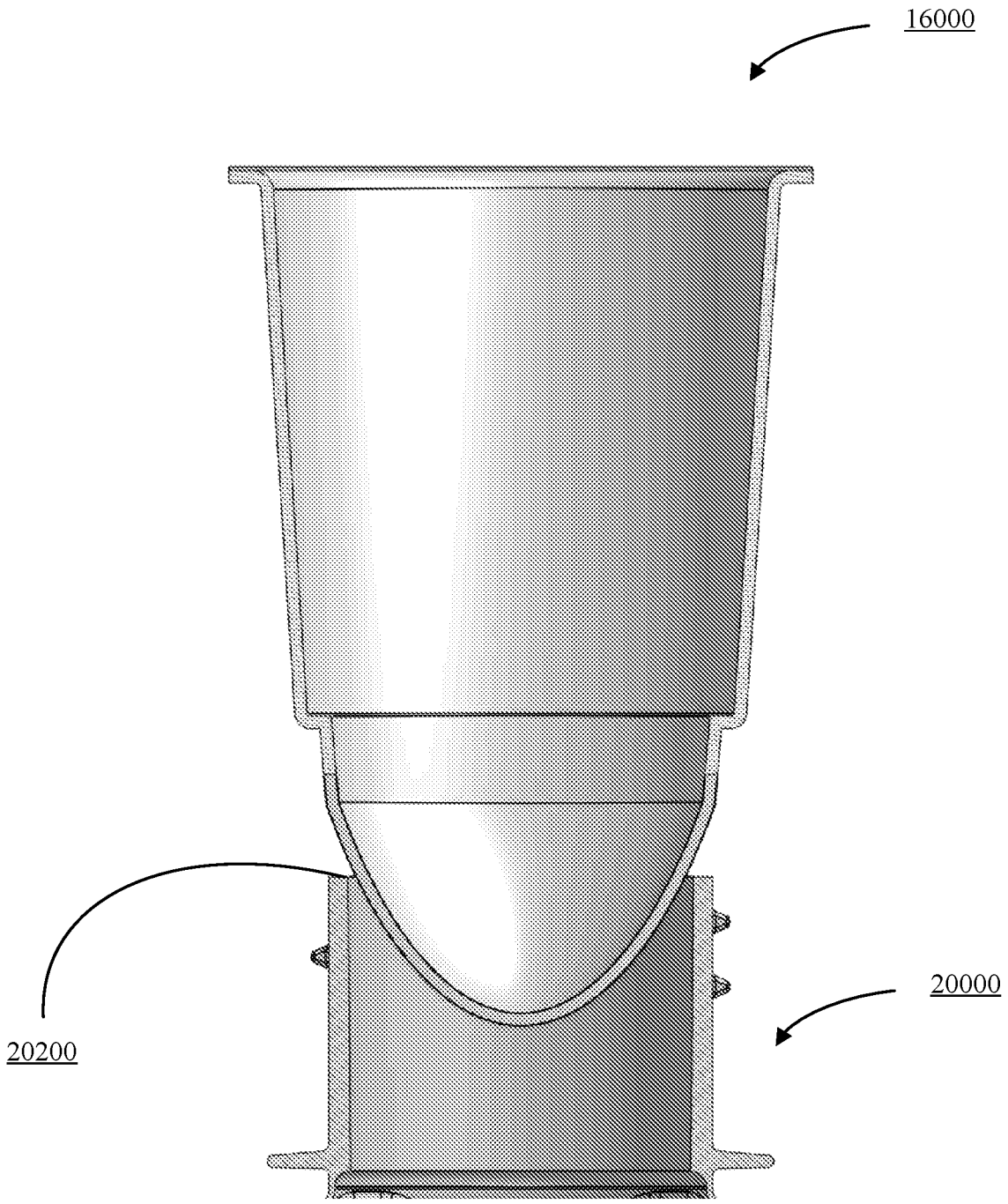
FIG. 25 is a cross-sectional view along a long axis juxtaposing the pod capsule of FIG. 16 with a receiving structure in an insertion state in accordance with implementations.

FIG. 16 is a diagram of a pod capsule 16000 in a sealed state in accordance with implementations. FIG. 17 is an exploded view of the pod capsule 16000 in accordance with implementations. FIG. 18 is a bottom view of the pod capsule 16000 in a closed state in accordance with implementations. FIG. 19 is a bottom view of the pod capsule 16000 in an open state in accordance with implementations. FIG. 20 is a diagram juxtaposing the pod capsule 16000 with a receiving structure 20000 in a pre-insertion state in accordance with implementations. FIG. 21 is a diagram juxtaposing the pod capsule 16000 with the receiving structure 20000 in an insertion state in accordance with implementations. FIG. 22 is a cross-sectional view along a short axis juxtaposing the pod capsule 16000 with the receiving structure 20000 in a pre-insertion state in accordance with implementations. FIG. 23 is a cross-sectional view along a short axis juxtaposing the pod capsule 16000 with the receiving structure 20000 in an insertion state in accordance with implementations. FIG. 24 is a cross-sectional view along a long axis juxtaposing the pod capsule 16000 with the receiving structure 20000 in a pre-insertion state in accordance with implementations. FIG. 25 is a cross-sectional view along a long axis juxtaposing the pod capsule 16000 with the receiving structure 20000 in an insertion state in accordance with implementations.

The pod capsule 16000 includes a lid 16100, a pod capsule container 16200, and a dispensing structure 16300. The pod capsule 1000 can contain contents 16400.

The pod capsule container 16200 includes a flange 16210 connected to a sidewall 16220, which in turn is connected to the dispensing structure 16300. The lid 16100 is fuseable to the flange 16210. As described herein, an interior surface of the pod capsule 16000 includes a barrier layer.

The dispensing structure 16300 includes an elliptical base 16310 connected to the pod capsule container 16200 and a pair of sidewalls 16320 tapering down from the base 16310 and connected by a rupture area 16330. The base 16310 includes a step 16332 which provides a positive stop when the pod capsule 16000 has been inserted far enough into the receiving structure 20000.

The dispensing structure 16300 has a short axis 16400 and a long axis 16500. The short axis 16400 is sized to fit the dispensing structure 16300 within an opening 20100 of a receiving structure 20000. The long axis 16500 is sized for the dispensing structure 16300 to engage or deform against a surface 20200 of a receiving structure 20000. That is, the diameter of an inside dimension of the receiving structure 20000 is smaller than a major diameter of the elliptical base 16310 (the long axis 16500) and larger than a minor diameter of the elliptical base 16310 (the short axis 16400).

Operationally, the rupture area 16330 can open, separate, or rupture (collectively "rupture") along or in the direction of the short axis 16500 when the dispensing structure 16300 is engaged along or in the direction of the long axis 16500 (as shown by arrows 19000). That is, upon insertion of the pod capsule 16000 into the receiving structure 20000, the rupture area 16330 ruptures up to the size of the opening 20100 of the receiving structure 20000. This results in dispensing of the contents 16400 into the receiving structure 20000.

In general, a pod capsule includes a molded pulp, paper, or fiber pod capsule container and a lid. The molded pulp, paper, or fiber pod capsule container includes a flange, a sidewall connected to the flange, an external surface of the sidewall including gripping sections, and a base connected to the sidewall. The lid is configured to be fused to the molded pulp, paper, or fiber pod capsule container, the lid including at least a removeable portion, where squeezing of the gripping sections causes contents in the pod capsule to be dispensed via a released removeable portion through a deformable contoured dispensing area.

In some implementations, the deformable contoured dispensing area is a rounded contour. In some implementations, the deformable contoured dispensing area is a beak-type contour. In some implementations, an internal surface of the molded pulp, paper, or fiber pod capsule container includes a barrier layer which is substantially chemically inert with the contents. In some implementations, an internal surface of the molded pulp, paper, or fiber pod capsule container includes a barrier layer which includes at least one of a moisture barrier, a grease barrier, a gas barrier, or an oil barrier. In some implementations, an internal surface of the lid includes a barrier layer which is substantially chemically inert with the contents. In some implementations, the pod capsule container includes two or more dispensing chambers. In some implementations, the two or more dispensing chambers are connected by a bridge section and the bridge section is covered by the lid. In some implementations, the at least a removeable portion covers the two or more dispensing chambers. In some implementations, one of the two or more dispensing chambers includes the contents and a remaining one of the two or more dispensing chambers includes a different contents. In some implementations, the at least a removeable portion is released when the gripping sections are squeezed. In some implementations, the at least a removeable portion is released by pulling on a tab on the at least removeable portion. In some implementations, the at least a removeable portion is partially defined by perforation lines. In some implementations, the tab is not fused to the flange. In some implementations, the at least a removeable portion of the lid is fused to the pod capsule container with a first adhesive and a remaining portion of the lid is fused to the pod capsule container with a second adhesive, the first adhesive having a weaker adhesion than the second adhesive.

In general, a pod capsule includes a dispensing structure, a lid, and a pod capsule container. The pod capsule container includes a flange connected to the lid and a sidewall connected to the flange. The dispensing structure includes an elliptical base connected to the sidewall, the elliptical base having a short axis and a long axis, a pair of tapering sidewalls connected to the base, and a rupture area connected to each of the pair of tapering sidewalls, where the short axis is sized to fit into a receiving structure and a long axis is sized to engage a surface of the receiving structure when the pod capsule is inserted into the receiving structure causing the rupture area to deform and open and release contents into the receiving structure.

In some implementations, the pod capsule is comprised of at least one of polymers, sustainable materials, recyclable materials, biodegradable materials, bio-based resins, weight-optimized biodegradable plastic, molded fiber, molded paper, molded pulp, fiber, paper, pulp paperboard, pressed pulp, fiber based, pressed fiber, paper, starch, cellulose, recycled plastic film, metals, metalized film, biodegradable resins, polylactic acid, polyhydroxyalkanoates, polyhydroxybutyrate, or polyethylene furanoate. In some implementations, the pod capsule is comprised of at least one of sustainable materials, recyclable materials, biodegradable materials, bio-based resins, weight-optimized biodegradable plastic, molded fiber, molded paper, molded pulp, fiber, paper, pulp paperboard, pressed pulp, fiber based, pressed fiber, paper, starch, cellulose, recycled plastic film, biodegradable resins, polylactic acid, polyhydroxyalkanoates, polyhydroxybutyrate, or polyethylene furanoate. In some implementations, an internal surface of the pod capsule includes a barrier layer which is substantially chemically inert with the contents. In some implementations, an internal surface of the pod capsule container includes a barrier layer which includes at least one of a moisture barrier, a grease barrier, a gas barrier, or an oil barrier. In some implementations, the elliptical base includes a step configured to provide a positive stop when the pod capsule is inserted into the receiving structure.

In general, a pod capsule includes a sustainable material pod capsule container and a lid. The sustainable material pod capsule container includes a flange, a sidewall connected to the flange, an external surface of the sidewall including gripping sections, and a base connected to the sidewall. The lid is configured to be fused to the sustainable material pod capsule container, the lid including at least a removeable portion, where squeezing of the gripping sections causes contents in the pod capsule to be dispensed via a released removeable portion through a deformable contoured dispensing area.

In some implementations, the sustainable materials is at least one of recyclable materials, biodegradable materials, bio-based resins, weight-optimized biodegradable plastic, molded fiber, molded paper, molded pulp, fiber, paper, pulp paperboard, pressed pulp, fiber based, pressed fiber, paper, starch, cellulose, recycled plastic film, biodegradable resins, polylactic acid, polyhydroxyalkanoates, polyhydroxybutyrate, or polyethylene furanoate. In some implementations, an internal surface of the pod capsule includes a barrier layer which is substantially chemically inert with the contents. In some implementations, an internal surface of the pod capsule container includes a barrier layer which includes at least one of a moisture barrier, a grease barrier, a gas barrier, or an oil barrier.

The construction and arrangement of the methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials and components, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions, and arrangement of the exemplary embodiments without departing from the scope of the present disclosure.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A pod capsule comprising:

a molded pulp, paper, or fiber pod capsule container, the molded pulp, paper, or fiber pod capsule container including:

a flange;

a tapering sidewall connected to the flange, an external surface of the sidewall including gripping sections; and a base connected to the tapering sidewall, wherein the base comprises a short axis and a long axis; and a lid configured to be fused to the molded pulp, paper, or fiber pod capsule container, the lid including at least a removeable portion, wherein squeezing of the gripping sections along the short axis causes the lid to pop open and contents in the pod capsule to be dispensed via the removeable portion through a deformable contoured dispensing area, and wherein decompression causes the lid to drop into a resting position on a top surface of the pod capsule.

2. The pod capsule of claim 1, wherein the deformable contoured dispensing area is a rounded contour.

3. The pod capsule of claim 1, wherein the deformable contoured dispensing area is a beak-type contour.

4. The pod capsule of claim 1, wherein an internal surface of the molded pulp, paper, or fiber pod capsule container includes a barrier layer which is chemically inert with the contents.

5. The pod capsule of claim 4, wherein an internal surface of the lid includes a barrier layer which is chemically inert with the contents.

6. The pod capsule of claim 1, wherein an internal surface of the molded pulp, paper, or fiber pod capsule container includes a barrier layer which includes at least one of a moisture barrier, a grease barrier, a gas barrier, or an oil barrier.

7. The pod capsule of claim 1, wherein the pod capsule container includes two or more dispensing chambers.

8. The pod capsule of claim 7, wherein the two or more dispensing chambers are connected by a bridge section and the bridge section is covered by the lid.

9. The pod capsule of claim 7, wherein the at least a removeable portion covers the two or more dispensing chambers.

10. The pod capsule of claim 7, wherein one of the two or more dispensing chambers includes the contents and a remaining one of the two or more dispensing chambers includes a different contents.

11. The pod capsule of claim 1, wherein the at least a removeable portion is released when the gripping sections are squeezed.

12. The pod capsule of claim 1, wherein the at least a removeable portion is released by pulling on a tab on the at least removeable portion.

13. The pod capsule of claim 12, wherein the tab is not fused to the flange.

14. The pod capsule of claim 1, wherein the at least a removeable portion is partially defined by perforation lines.

15. The pod capsule of claim 1, wherein the at least the removeable portion of the lid is fused to the pod capsule container with a first adhesive and a remaining portion of the lid is fused to the pod capsule container with a second adhesive, the first adhesive having a weaker adhesion than the second adhesive.

16. A pod capsule comprising:

a dispensing structure;

a lid; and a pod capsule container, the pod capsule container including:

a flange connected to the lid; and a sidewall connected to the flange; and the dispensing structure including:

an elliptical base connected to the sidewall, the elliptical base having a short axis and a long axis;

a pair of tapering sidewalls connected to the base; and a rupture area connected to each of the pair of tapering sidewalls, wherein the short axis is sized to fit into a receiving structure and a long axis is sized to engage a surface of the receiving structure when the pod capsule is inserted into the receiving structure causing the rupture area to deform and open and release contents into the receiving structure.

17. The pod capsule of claim 16, wherein the pod capsule is comprised of at least one of polymers, sustainable materials, recyclable materials, biodegradable materials, bio-based resins, weight-optimized biodegradable plastic, molded fiber, molded paper, molded pulp, fiber, paper, pulp paperboard, pressed pulp, fiber based, pressed fiber, paper, starch, cellulose, recycled plastic film, metals, metalized film, biodegradable resins, polylactic acid, polyhydroxyalkanoates, polyhydroxybutyrate, or polyethylene furanoate.

18. The pod capsule of claim 16, wherein the pod capsule is comprised of at least one of sustainable materials, recyclable materials, biodegradable materials, bio-based resins, weight-optimized biodegradable plastic, molded fiber, molded paper, molded pulp, fiber, paper, pulp paperboard, pressed pulp, fiber based, pressed fiber, starch, cellulose, recycled plastic film, biodegradable resins, polylactic acid, polyhydroxyalkanoates, polyhydroxybutyrate, or polyethylene furanoate.

19. The pod capsule of claim 16, wherein an internal surface of the pod capsule includes a barrier layer which is chemically inert with the contents.

20. The pod capsule of claim 16, wherein an internal surface of the pod capsule container includes a barrier layer which includes at least one of a moisture barrier, a grease barrier, a gas barrier, or an oil barrier.

21. The pod capsule of claim 16, wherein the elliptical base includes a step configured to provide a positive stop when the pod capsule is inserted into the receiving structure.

* * * * *